343-700 MS AU 254 EX
11/8/83 XR 4,414,453

United States Patent [19]

Simpson

[11] 4,414,453

[45] Nov. 8, 1983

[54] MICROWAVE OVEN FEED APPARATUS

[75] Inventor: James E. Simpson, Coralville, Iowa

[73] Assignee: Raytheon Company, Lexington, Mass.

[21] Appl. No.: 209,847

[22] Filed: Nov. 24, 1980

Related U.S. Application Data

[62] Division of Ser. No. 971,727, Dec. 21, 1978, Pat. No. 4,284,868.

[51] Int. Cl.[3] ..... H05B 6/72

[52] U.S. Cl. ..... 219/10.55 F; 343/844; 343/700 MS

[58] Field of Search ..... 219/10.55 F, 10.55 R; 343/731, 700 MS, 732, 741, 772, 844, 879, 795

[56] References Cited

U.S. PATENT DOCUMENTS

| | | | |
|---|---|---|---|
| 2,642,528 | 6/1953 | Albright | 343/795 |
| 3,369,245 | 2/1968 | Rea | 343/795 |
| 3,436,507 | 4/1969 | Puschner | 219/10.55 F |
| 3,562,471 | 2/1971 | White | 219/10.55 F |
| 3,619,536 | 11/1971 | Boehm | 219/10.55 B X |
| 3,805,009 | 4/1974 | Sweet | 219/10.55 F |
| 3,814,890 | 6/1974 | Klemp et al. | 219/10.55 F |
| 3,947,850 | 3/1976 | Kaloi | 343/795 |
| 4,028,519 | 6/1977 | Deweese et al. | 219/10.55 R |
| 4,028,520 | 6/1977 | Torrey | 219/10.55 F |
| 4,028,521 | 6/1977 | Uyeda | 219/10.55 F |
| 4,054,874 | 10/1977 | Oltman, Jr. | 343/700 MS |
| 4,071,846 | 1/1978 | Oltman, Jr. | 343/700 MS |
| 4,165,454 | 8/1979 | Carlsson et al. | 219/10.55 F |
| 4,176,266 | 11/1979 | Kaneko et al. | 219/10.55 F |
| 4,342,896 | 8/1982 | Teich | 219/10.55 R X |

FOREIGN PATENT DOCUMENTS

| | | | |
|---|---|---|---|
| 2312165 | 12/1976 | France | 219/10.55 F |

*Primary Examiner*—M. H. Paschall
*Assistant Examiner*—Philip H. Leung
*Attorney, Agent, or Firm*—William R. Clark; Joseph D. Pannone

[57] ABSTRACT

A microwave oven having a directional rotating antenna axially supported on an axis of one wall of a microwave oven cavity of the microwave oven which provides circularly symmetric uniform energy distribution of microwave energy within the microwave oven cavity and consistent heating of a product in the microwave oven cavity. The directional rotating antenna includes a two-by-two array of antenna elements where each element is an end driven half-wavelength resonating antenna element supported by a length of conductor perpendicular to the wall of the microwave oven cavity. A parallel plate transmission line connects to each of the supports, four of which join at a junction which connects to a cylindrical probe antenna. The probe antenna is excited by microwave frequency currents of a waveguide adjacent to the wall of the microwave oven cavity. The directional antenna is rotated by a moving stream of air circulated through the microwave oven cavity. A dome having a flattened conical shape extending outwardly in the wall of the microwave oven cavity provides a nearly circular recess partially surrounding the directional rotating antenna and provides uniform energy distribution in the product being heated. The dome returns microwave energy reflected from the product towards a circular area in the middle area of the microwave oven cavity. A transition section extends between the top of the dome and the one wall of the microwave oven cavity. The waveguide including three sides affixed to the outside wall of the dome, the transition section, and an extension of the wall extending beyond the microwave oven cavity which supports the microwave power source, all of which comprise the fourth wall of the waveguide. The microwave oven provides a consistent cooking pattern, especially for sensitive foods by utilizing high power of the microwave power source.

7 Claims, 28 Drawing Figures

Fig. 12A
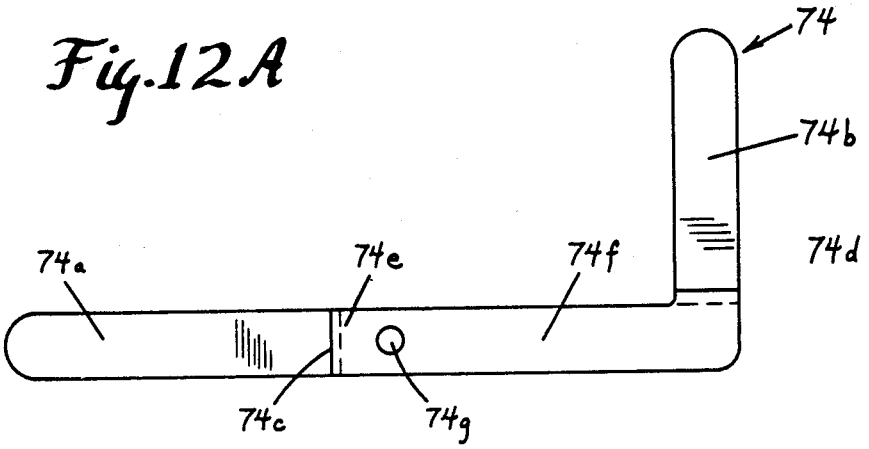
Fig. 12B
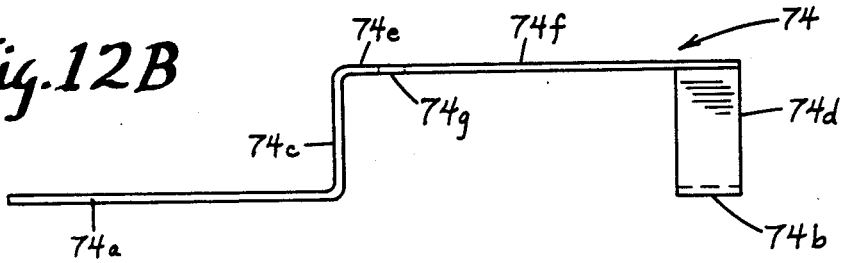
Fig. 13A
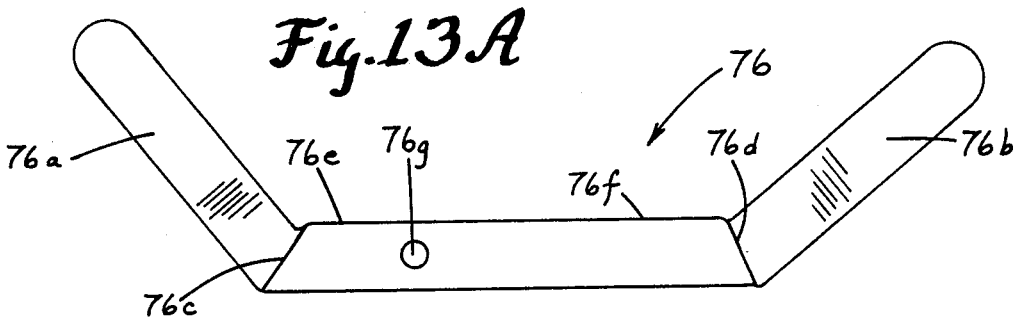
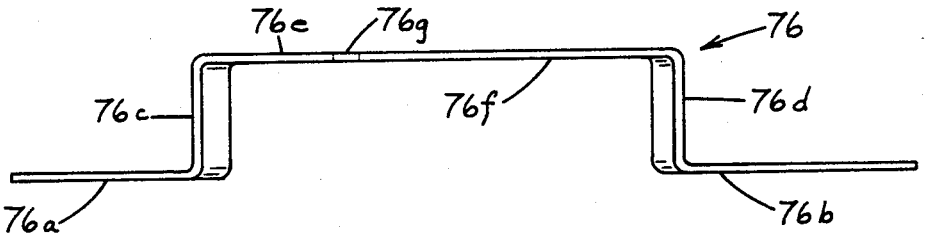
Fig. 13B

Fig. 16
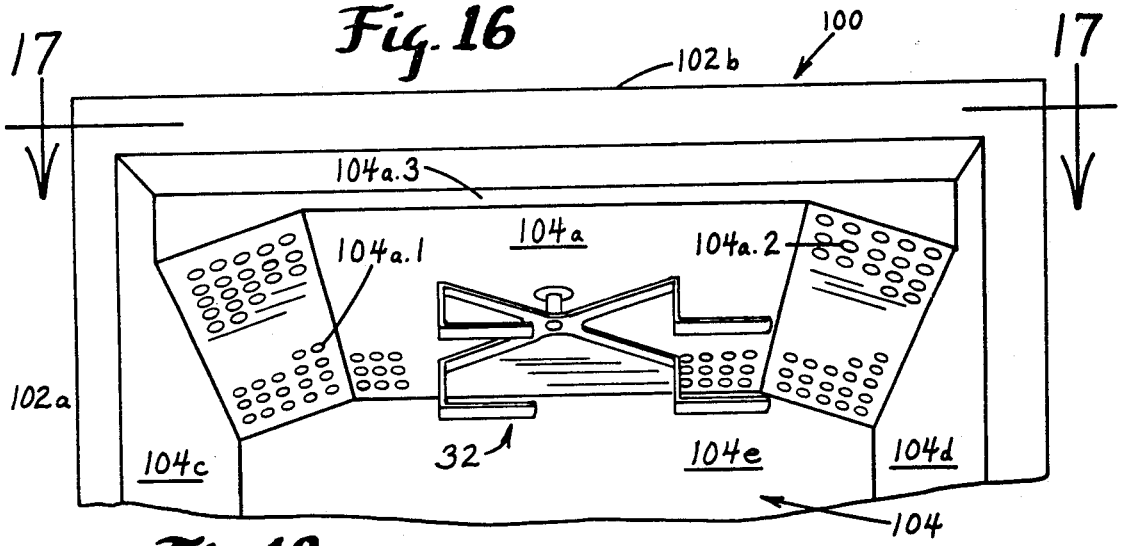
Fig. 18
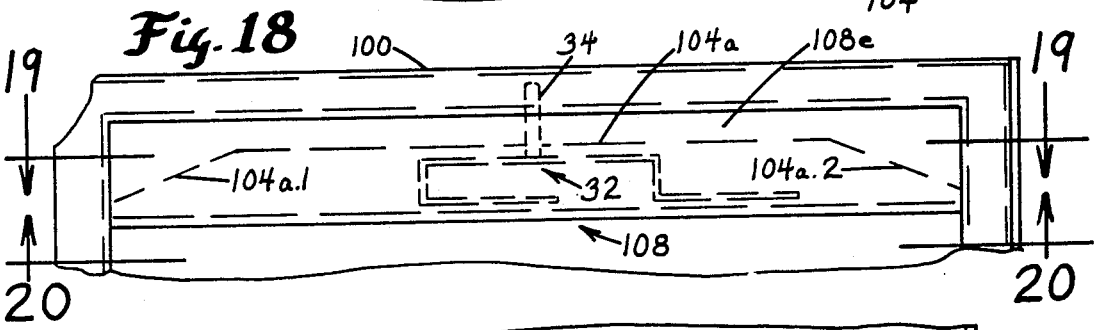
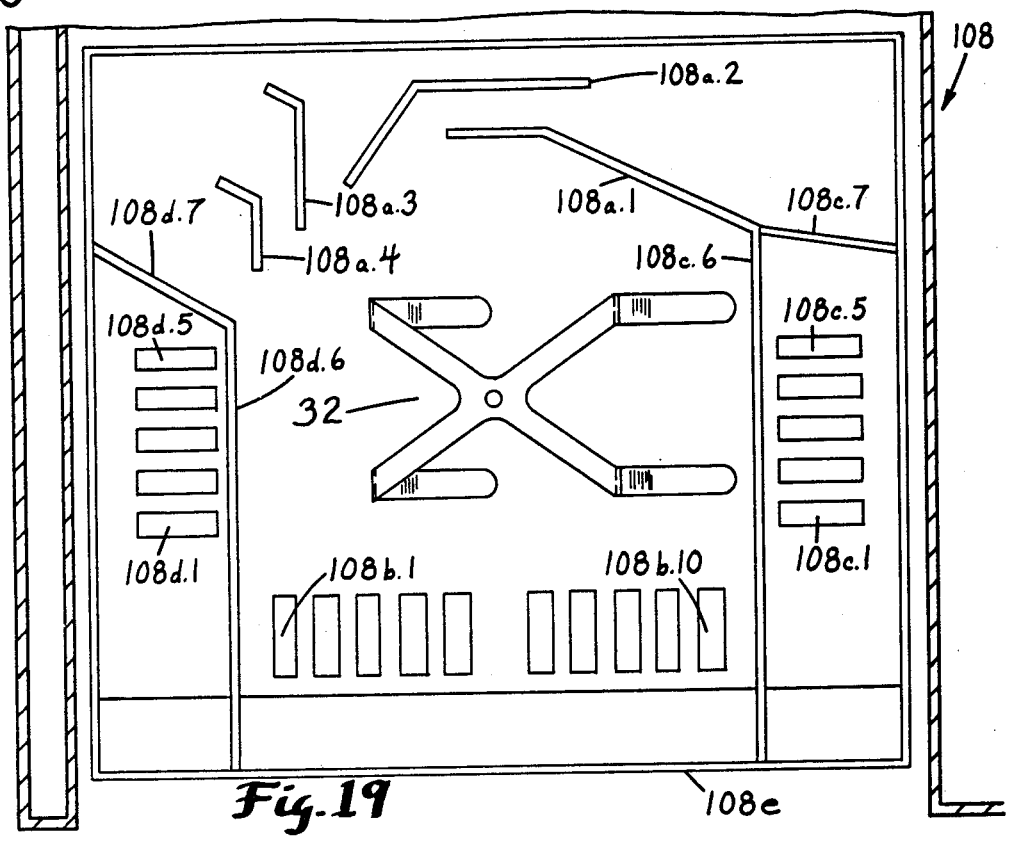
Fig. 19

MICROWAVE OVEN FEED APPARATUS

CROSS REFERENCES TO COPENDING APPLICATIONS

This is a division of application Ser. No. 971,727, filed Dec. 21, 1978, now U.S. Pat. No. 4,284,868.

BACKGROUND OF THE INVENTION

1. Field of the Invention

The present invention relates generally to heating with electromagnetic wave energy in a conductive cavity, and more particularly, pertains to a directional rotating antenna rotated about an axis axis of one wall of a microwave oven cavity of a microwave oven which provides uniform energy distribution and a consistent cooking pattern of food products.

2. Description of the Prior Art

Prior art microwave ovens suffer from nonuniform energy distribution, and more particularly, nonuniform heating patterns depending upon the type of particular product, which usually is food, being heated. The degree of the nonuniform heating pattern relates to the specific type of product being heated. The nonuniform heating pattern occurs because of unequal distribution of microwave energy coupled into a conductive cavity of a microwave oven from a source of microwave power such as a magnetron, and from the reflections of microwave energy from the produce within the microwave oven cavity and the conductive walls framing the microwave oven cavity. Multiple reflections within the conductive microwave oven cavity occur and produce configurations of the electromagnetic fields referred to as mmodes. These reflections cause constructive and destructive interference at and in different parts of the product being heated, and therefore, result in hot areas intermixed with cold areas. Where the product is food, the result is overcooked areas of the food intermixed with undercooked areas of the food. In some food products, the cooking time and thus energy consumption may be increased to fill in the undercooked areas as any overcooked areas may be less objectionable.

Some food products which have been particularly difficult to cook in the prior art microwave ovens include yeast products such as breads; baked products such as cakes and pies; scattered products such as cookies, appetizers, and hors d'oeuvres, and; egg dishes such as custards and quiches. All of these types of food products when cooked in many of the prior art microwave ovens have exhibited overcooked areas intermixed with undercooked areas leaving much to be desired in the cuisine of the consuming gourmet. The cooking of other types of food products require cooking at low power in addition to manual cooking manipulations in an attempt to obtain even cooking which has not always been possible to achieve with the prior art microwave ovens.

The principal process for improving nonuniform heating patterns in the prior art microwave ovens has been mode stirring which attempts to randomize reflections by introducing a time-varying scattering of the microwave energy. Mode stirring can be characterized as a change of energy distribution of the different modes in the microwave oven cavity. Most systems utilizing mode stirrers position the mode stirrer at the waveguide-microwave oven cavity junction where the waveguide couples microwave energy from the microwave power source to the microwave oven cavity and require turning of the product such as food. The mode stirrers are not as effective since hot spots intermixed with cold spots continue to exist in the heated product. Hot spots intermixed with cold spots are also a function of the nonuniformity of the product such as fat versus lean, ice versus water, and other density factors.

Another process for improving the nonuniform heating patterns in the prior art microwave ovens has been utilizing a turntable within the microwave oven cavity to rotate the product about a center axis of the microwave oven cavity through an uneven energy pattern. The turntable wastes useful oven space and requires additional complex mechanical components. Sometimes, the turntables compliment microwave ovens having mode stirrers. Regardless of the process of utilizing a turntable or a turntable and mode stirrer, hot spots intermixed with cold spots still exist in the heated product.

A further process for improving the nonuniform heating patterns in the prior art microwave ovens has been utilizing rotatable antennas or exciters within the microwave oven cavity. The prior art rotatable antennas or exciters have failed to provide uniform heating patterns in the product being heated. An example of representative prior art patents disclosing a rotatable antenna are U.S. Pat. Nos. 4,028,519, 4,028,520 and 4,028,521.

Prior art directional antennas for uses not associated with microwave ovens have been described in many configurations. Those of compact size employing linear radiating elements are usually assembled from rows of resonant dipoles fed at their centers by balanced transmission lines. Such antennas may be excited from a waveguide through the use of a rotating joint and an unbalanced-to-balanced line balun transformer. The energy is then routed to the antenna elements by a balanced transmission line which consists of two symmetrical conductors. This approach would be very difficult to implement in a consumer microwave oven where its complexity would increase overall costs, especially when a substantial power must be handled with poor and unpredictable loads. Furthermore, such a structure would be very heavy and mechanically difficult to rotate by air or motor.

The present invention provides a microwave oven having a uniform energy distribution and a consistent heating pattern that overcomes many of the disadvantages of the prior art microwave ovens.

SUMMARY OF THE INVENTION

The purpose of the present invention is to provide a microwave oven with a directional rotating antenna partially surrounded by a flattened conical shaped dome about an axis of a microwave oven cavity which provides uniform energy distribution and a consistent heating pattern for a product being heated with the microwave oven cavity in addition to surrounding the antenna with stable reflections as the antenna rotates about the axis of the dome and reflecting microwave energy reflected from the product being heated back towards a circular area in the middle of the microwave oven cavity.

According to one embodiment of the present invention, there is provided a microwave oven having a conductive microwave oven cavity; a flattened conical shaped dome in a wall of the microwave oven cavity; an extension of the wall beyond the microwave oven cavity supporting a microwave power source; a tapered transition on the dome for matching impedance; a three-sided waveguide attached to the opposite side of the dome, the tapered transition, the wall, and the extension of the wall where the dome, the tapered transition section, and walls is the fourth side of the waveguide; a dielectric rotation bushing affixed at the center axis of the dome; a probe antenna axially supported in the dielectric bushing and partially extending between the waveguide and the dome; a directional rotating antenna including a two-by-two array of four primary end driven half-wavelength resonating elements parallel to the wall and partially surrounded by the dome, a length of support conductor perpendicular to the wall and supporting each of the elements, and a parallel plate microstrip transmission line connected between each of support conductors, parallel to the top wall, and four of which join at a junction to the probe antenna; turbine vanes affixed to the antenna; and, a source of air ducted into the cavity to rotate the antenna whereby the directional rotating antenna continuously illuminates the microwave oven cavity with microwave energy during rotation of the antenna, and the dome partially surrounds the antenna with stable reflections as the antenna rotates about the axis and also returns the microwaves reflected from the product towards a circular area in the microwave oven cavity thereby providing uniform energy distribution of microwave energy and a consistent heating pattern of a product in the cavity.

One significant aspect and feature of the present invention is to provide uniform energy distribution of microwave energy within the microwave oven cavity and especially, a consistent cooking pattern for foods including sensitive foods which could never before be easily cooked in microwave ovens such as yeast breads, cakes, quiches, and scattered foods such as cookies. The cooking of foods is faster allowing shorter cooking times.

Another significant aspect and features of the present invention is to provide a directional rotating antenna for illuminating the interior of the microwave oven cavity with uniform microwave energy distribution. The directional rotating antenna provides maximum uniform rotating field intensity in the center of the microwave oven cavity. The directional rotating antenna is a beam directional rotating antenna which radiates and beams a rotating E field in a downward plane from the antenna, and is not dependent on the walls of the microwave oven cavity to distribute the microwave energy. The directional rotating antenna is defined as an antenna array of at least two radiating antenna elements, and is not to be construed as a limiting phrase in any sense.

A further significant aspect and feature of the present invention is to provide a microwave oven cavity having a flattened conical shape dome including a rectangular transition section in the top wall of the microwave oven cavity which serves as one side of a three-sided waveguide and provides a uniform heating pattern by partially surrounding the directional rotating antenna with stable reflections as the antenna rotates about the center axis of the dome and returns microwaves reflected from the product being heated towards a circular area in the middle of the cavity to further enhance the uniform heating pattern. The dome provides a circularly symmetrical consistent distribution of microwave energy towards the product being heated in the microwave oven.

Having briefly described one embodiment of the present invention, it is a principal object hereof to provide a microwave oven having uniform energy distribution of microwave energy in the product being heated in the microwave oven cavity.

An object of the present invention is to provide uniform energy distribution of microwave energy in a conductive microwave oven cavity and a consistent uniform heating pattern in a product being heated in the cavity, especially food. The present invention provides uniform heating of foods, especially sensitive foods, requiring only short periods of time. The present invention provides for the microwave cooking of sensitive foods such as yeast breads, cakes, quiches, and scattered loads such as cookies as well as the ordinary foods cooked by microwave ovens. The microwave cooking of foods according to the present invention is faster for small and compact loads, and requires virtually no manual cooking manipulations of the food during microwave cooking even though food manipulations may be required depending upon the type of food. The present invention has virtually eliminated the need for rotating of food which sometimes inadvertently is referred to as turning. Food manipulations such as turning the food over or stirring the food due to the density of the food product such as large meats or poultry and liquids such as sauces may still be required.

Another object of the present invention is to provide a directional rotating antenna for uniform microwave energy distribution in a product being heated within the conductive microwave oven cavity of the microwave oven. The antenna is rotated about the axis by a moving stream of air passing through the microwave oven cavity or in an alternative embodiment, the antenna can be mechanically rotated. The antenna incorporates a turbine vane structure made of dielectric material which minimizes the effect on the radiating pattern. The utilization of the directional rotating antenna reduces interference between the direct waves and waves reflected from the sidewalls of the cavity by minimizing the microwave energy radiated toward the sidewalls of the cavity. The directional rotating antenna is a two-by-two array of four primary end driven half-wavelength resonating elements which connect to an axially supported probe in the microwave oven cavity by vertical support elements through parallel plate microstrip transmission lines connected at a junction to the axially supported probe antenna. Half-wavelength spacing of opposing parallel elements of the directional rotating antenna provides for cancellation of the E fields radiated horizontally, and therefore, eliminates radiation towards the sidewalls. Also, little radiation is emitted from the ends of each of the elements towards the sidewalls of the microwave oven cavity. This reduction of field excitation towards the nearest portion of the sidewalls reduces the reflections back toward the directional rotating antenna from the sidewalls, and thus reduces the perturbation of the antenna impedance by these reflections. The reduction of perturbation to the antenna impedance contributes to the uniformity of energy distribution in the product being heated within the microwave oven cavity.

A further object of the present invention is to provide a microwave oven having a flattened conical shaped dome in a wall of the microwave oven cavity extending outwardly from the wall of the cavity and particularly, in the top wall of the microwave oven cavity. A rectangular transition section is provided between the top wall of the dome and the top wall of the microwave oven. The section is one-half wavelength long and serves as an impedance transition between the microwave power source and the directional rotational antenna. The tapered section also joins the waveguide at the microwave power source to the reduced height of the waveguide above the dome having a probe antenna axially mounted in the center of the dome and connected to the directional rotating antenna. The dome also provides uniform energy distribution by partially surrounding the antenna with stable reflections as the antenna rotates about the center axis of the dome and also returns microwaves reflected from the heated product towards a circular area in the middle of the microwave oven cavity. The dome provides for the utilization of a directional rotating antenna within the microwave oven cavity and provides a radiation pattern of circularly symmetric uniform distribution of microwave energy in the microwave oven cavity. The symmetry of the dome also provides uniformity of the antenna impedance.

An additional object of the present invention is to provide a microwave oven having simplified construction in using only two sheet metal parts to comprise the top; one of the components being the top wall of the microwave oven cavity including the flattened conical shaped dome, a top wall extension for the microwave energy power source support, the air baffle, and the fan support, and the other component being a three-sided waveguide. The fourth side of the waveguide includes the flat truncated dome, the rectangular transition section, and the top wall extension. The two sheet metal components of the microwave oven cavity top which includes a flattened conical shaped dome having the tapered transition section and the three-sided waveguide permits the use of automatic resistance spot welding equipment during assembly of the microwave oven. Overall, reduced height in the oven is achieved by reduced waveguide height which places the waveguide, the flattened conical shaped dome and the probe antenna of the directional rotating antenna within the vertical height of the waveguide required to clear the antenna of the microwave power source. The particular construction of the microwave oven cavity lends itself to mechanical welding fabrication which eliminates expensive and time-consuming manual fabrication. More importantly, the particular fabrication lends itself to economical fabrication of a stainless steel conductive microwave oven cavity with automated mechanical welding equipment eliminating the need of manual fabrication of the components of the microwave oven cavity.

Still another object of the present invention is to provide a microwave oven cavity having uniform energy distribution and providing uniform heating of a product in a microwave oven cavity, especially food products. Particularly, the microwave oven of the present invention provides for consistent even heating in foods such as baked goods and yeast products enabling cooking in a short period of time never before having been achievable in a microwave oven. Specifically, the microwave oven of the present invention has overcome the shortcomings of the prior art by providing a microwave oven which consistently and evenly cooks baked goods, yeast breads, quiches, in addition to cooking of scattered products such as cupcakes, appetizers, hors d'oeuvres, hot dogs, sausage, hamburgers, bacon, etc. Baked goods have even smooth surfaces. The microwave oven also cooks such foods as cookies, egg dishes such as egg custards, and yeast breads. Also, the microwave oven provides better food quality where breads and cakes turn out lighter and fuller, eggs become fluffier, meats brown more evenly, and ordinary foods look and taste better. Further, the microwave oven provides uniform energy distribution and heating so that evaporation of moisture from the food product is minimum.

A still further object of the present invention is to provide a microwave oven cavity which provides for the uniform heating of products over shorter periods of time, specifically heating products faster in the middle of the product and the heating traversing outwards under full power of the microwave power source. The microwave oven of the present invention provides for directing the microwave energy towards the center of the microwave oven for efficient and uniform energy distribution of the microwave energy, and further providing for maximum uniform field intensity in the center of the microwave oven. The radiated electromagnetic field pattern is uniformly center loaded, concentrically even, and consistent. By directing the microwave energy uniformly at the center of the cavity, a hot cylindrical area centrally located on a vertical axis at the center of the microwave oven is provided in the center of the food being heated, and extends uniformly and radially outwards from the center of the food. This is advantageous for single loads such as for a cup of coffee or hot chocolate; for large loads such as cakes, meat loaf, roasts, chicken, and the like; and, for scattered loads such as bacon, hot dogs, cupcakes, appetizers, and hors d'oeuvres. The microwave oven of the present invention virtually eliminates the need for manual cooking manipulations of the foods being rearranged, turned or rotated. If any manipulation is required, food manipulation is only required for particular types of food being cooked such as pudding instead of cooking manipulations which were required with the prior art microwave ovens. While certain foods are still required to be turned over in food manipulations such as roasts, turkey, chicken, and poultry for best cooking results, rotational cooking manipulations of the food are not required. More foods can be cooked at full power in shorter periods of time and manual cooking manipulations are not required with the microwave oven of the present invention because of the efficient uniform energy distribution of microwave energy.

A still additional object of the present invention is to provide a microwave oven which cooks foods consistently and uniformly which were not particularly suited to cooking in the prior art microwave ovens. The microwave oven of the present invention provides for the cooking of baked goods such as cakes and cookies; egg dishes such as egg custards and quiches; small loads such as cups of coffee or hot chocolate; and, scattered loads such as cupcakes, appetizers, and hors d'oeuvres. Also, the microwave oven of the present invention provides that goods can be cooked at full power with consistency and evenness at faster cooking speeds resulting in perfect cooking of the foods.

A still further object of the present invention is to provide a microwave oven which has a larger size oven cavity with the same outside housing dimensions resulting from the flattened conical dome shape on the top wall of the microwave oven cavity partially surrounding the two-by-two directional rotating antenna array of four half-wavelength end resonating elements. The antenna, partially surrounding by the dome in the top wall in the cavity, takes up considerably less space than the prior art mode stirrers and as a secondary consequence, the grease shield shielding the antenna is smaller thereby further attributing to the larger size of the microwave oven cavity.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein:

FIG. 12A illustrates a top view of a still additional embodiment of a directional rotating antenna;

FIG. 12B illustrates a front view of the still additional embodiment of the directional rotating antenna;

FIG. 13A illustrates a top view of still another embodiment of a directional rotating antenna;

FIG. 13B illustrates a front view of still another embodiment of the directional rotating antenna;

FIG. 16 illustrates a front perspective view of another embodiment of a microwave oven;

FIG. 18 illustrates an upper front view of the microwave oven;

FIG. 19 illustrates a section of the present invention taken on line 19—19 of FIG. 18 looking in the direction of the arrows and shows a top view of a grease shield;

DESCRIPTION OF THE PREFERRED EMBODIMENTS

Figure 1:
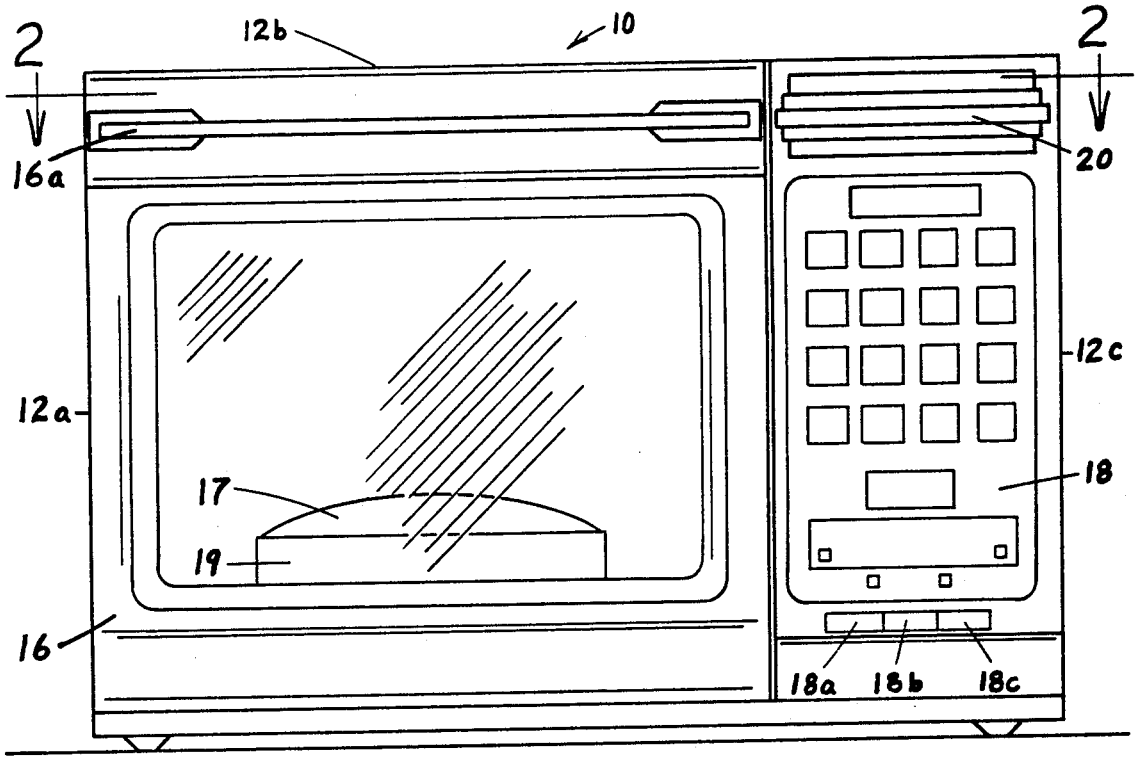
FIG. 1 illustrates a front view of a microwave oven of the present invention.
Figure 3:
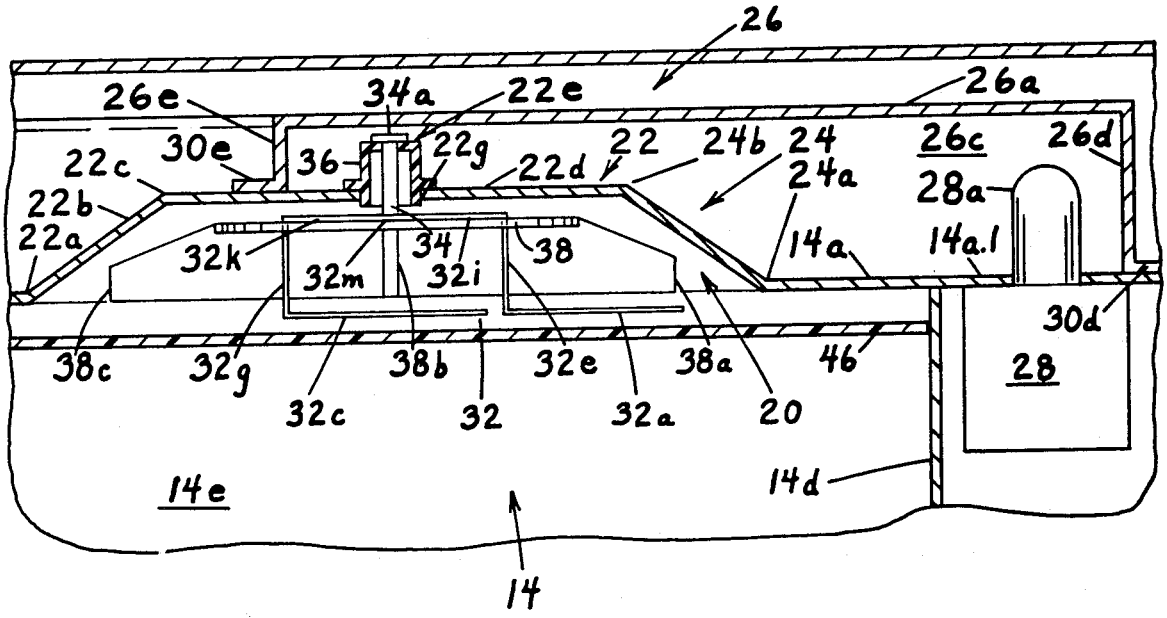
FIG. 3 illustrates a section of the present invention taken on line 3—3 of FIG. 2 looking in the direction of the arrows and illustrates a front view of microwave oven partially cutaway.

FIG. 1, which illustrates a front view of a microwave oven 10 of the pesent invention, shows the microwave oven 10 having a three-sided channel shaped housing cover **12*a*–12*c* rspectively housing the internal components of the microwave oven 10 as now described. A microwave oven cavity 14 of the microwave oven 10 as illustrated in FIG. 3 having five conductive metallic sides such as stainless steel by way of example and for purposes of illustration only includes a top wall 14*a*, a bottom wall 14*b* not illustrated in the figures, a left sidewall 14*c* illustrated in FIG. 2, a right sidewall 14*d*, and a rear wall 14*e* which are secured to each other such as by welding to form the five-sided conductive microwave oven cavity 14. A bottom hinged door 16 pivots within the confines of the walls 14*a*–14*d* of the microwave oven cavity 14, and includes microwave energy absorbing structure such as a quarter wave choke and a carbon impregnated door gasket surrounding the outside perimeter of the door 16 to dissipate any leakage of microwave energy between the walls 14*a*–14*d* and the outer perimeter of the door 16. A see-through window by way of example and for purposes of illustration only affixes in the center of the door 16. A door handle 16*a* on the top of the hinged door 16 facilitates opening and closing of the door 16. A cake 17 in a glass cake pan 19 cooks in the microwave oven 10 and is observed through the door 16. An automatic safety latch lever not illustrated in the figure mounts on one side of the door 16 to lock the door 16 in a closed position when the microwave oven 10 is energized. A control panel 18 supports a plurality of programmable keyboard controls connected to microprocessor control circuitry or electromechanical control circuitry to control a microwave oven power supply connected to a microwave power source for predetermined heating time, temperature, and power levels. Start, stop, and microwave cavity light switches 18*a*, 18*b*, and 18*c* respectively are positioned at the bottom of the control panel 18. An exhaust vent 20 mounts in the upper front right corner of the microwave oven 10 directly above the control panel 18 to exhaust cavity vapors and moisture from the microwave oven cavity 14** as later described.

Figure 2:
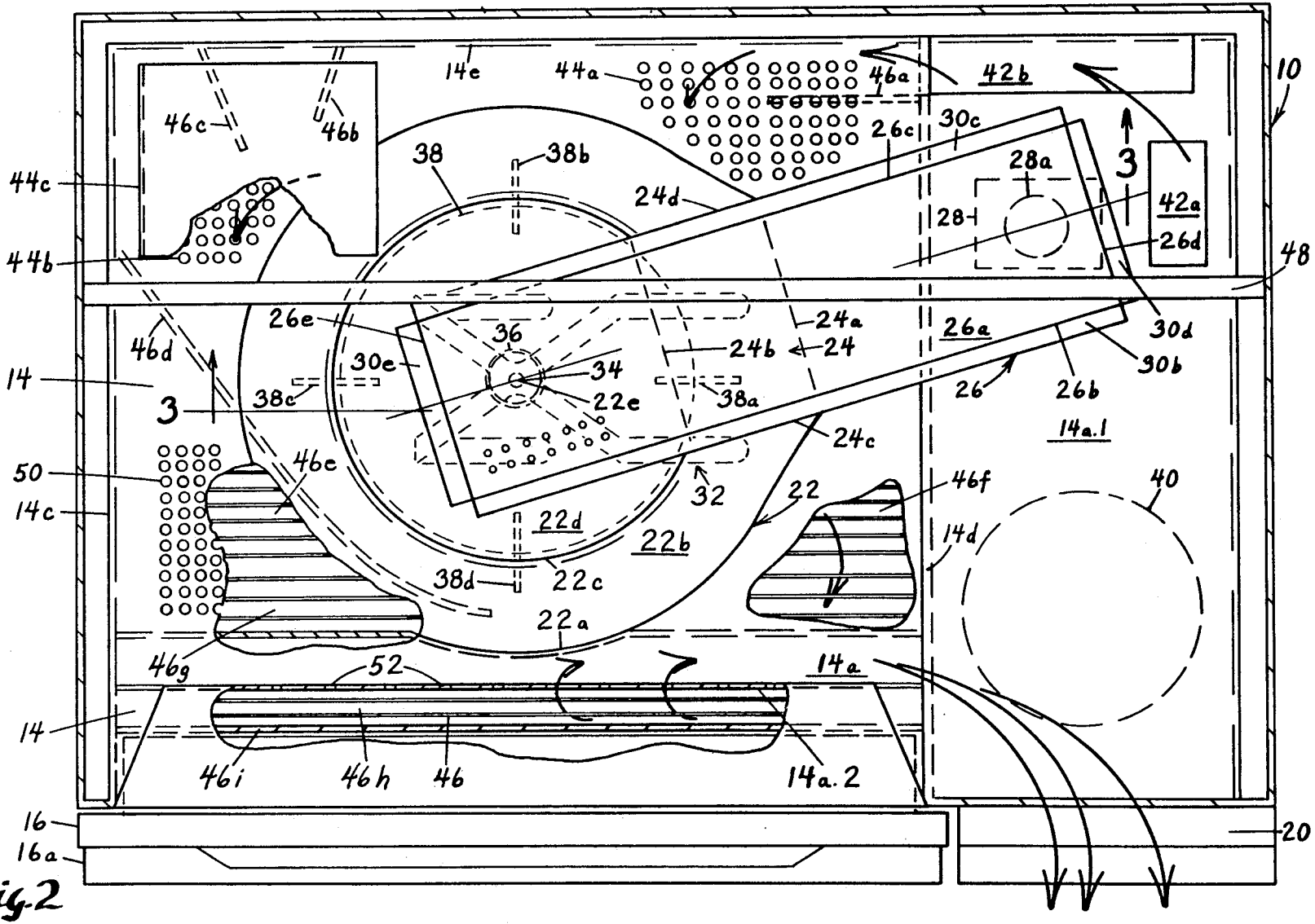
FIG. 2 illustrates a section of the present invention taken on line 2—2 of FIG. 1 looking in the direction of the arrows and illustrates a top view of the microwave oven partially cutaway.

FIG. 2, which illustrates a section of the present invention taken on line 2—2 of FIG. 1 looking in the direction of the arrows and partially cutaway, shows a top view of the microwave oven 10. A truncated flattened conical shaped dome 22 having a large diameter **22*a* positions in the top wall 14*a* of the microwave oven cavity 14. An angular sloping section 22*b* including a planar rectangular transition section 24 as later described extends above the top wall 14***a* of the microwave oven cavity 14 to a small diameter 22*c* which determines the angular degree of the slope of the dome 22. A planar truncated flattened top wall 22*d* of the dome 22 is parallel to the top wall 14*a* of the microwave oven cavity 14. The rectangular transition section 24 provided on the angular slope section 22*b* of the dome 22 includes a lower transition junction 24*a* between the top wall 14*a* of the microwave oven cavity 14 and the transition section 24, and an upper transition junction 24*b* between the transition section 24 and the flattened wall 22*d* of the dome 22. A front junction 24*c* and a back junction 24*d* extend between the junctions 24*a* and 24*b* respectively along the longitudinal length of the transition section 24. A three-sided waveguide 26, having tapers on opposing vertical sidewalls corresponding to the tapers of the dome 22 and the rectangular transition section 24, affixes between a microwave power source 28 having a probe antenna 28*a* on an extension 14*a*.1 of the top wall 14*a* of the microwave oven cavity 14 and beyond a center 22*e* on the flat wall 22*d* of the dome 22. The waveguide 26 includes a top wall 26*a*, vertically tapered sidewalls 26*b* and 26*c*, and end walls 26*d* and 26*e* where the distance between the end wall 26*e* to the center 22*e* of the dome 22 adjusts the matching of the microwave power source 28 to the microwave oven cavity 14 as later described. Flanges 30*b*, 30*c*, 30*d*, and 30*e* are provided at the bottom of the sidewalls 26*b*, 26*c*, 26*d*, and 26*e* respectively of the waveguide 26 to affix the waveguide 26 to the top wall extension 14*a*.1, the top wall 14*a*, the tapered section 24, and the top portion 22*d* of the dome 22 of the microwave oven cavity 14, all of which serve as the fourth bottom wall of the waveguide 26 respectively. A directional rotating antenna 32 illustrated in dashed lines and also referring to FIGS. 6–8 includes four end driven half-wavelength by way of example and for purposes of illustration only resonating elements 32*a*–32*d* parallel to the top wall 14*a* and dome wall 22*d*, supports 32*e*–32*h* connect to each of the elements 32*a*–32*d*, transmission line conductor members 32*i*–32*l* substantially parallel to the top wall 14*a* which form parallel plate microstrip transmission lines with dome wall 22*d* of the microwave oven cavity 14 which connect to each of the supports 32*e*–32*h* and join at a junction 32*m*. A probe antenna 34 having a capacitive hat 34*a* axially mounts in a dielectric bushing 36 located at the center 22*e* of the dome 22 and connects to the junction 32*m* of the directional rotating antenna 32. The probe antenna extends between the microwave oven cavity 14 and partially into the waveguide 26 above the top wall 22*d* of the dome 22. A dielectric disc 38 surrounds the parallel plate transmission lines 32*i*–32*l* and affixes thereto. A plurality of turbine vane blades 38*a*–38*d* position around the circular disc 38 and are driven by forced air velocity flow through the microwave oven cavity 14 as later described in detail. A blower 40 such as a squirrel cage blower, by way of example and for purposes of illustration only, draws air up through a plurality of holes not illustrated in the bottom of the microwave oven 10, between the bottom of the microwave oven 10 and the bottom wall 14*b* of the microwave oven cavity 14, past the control panel 18 and microwave oven power supply components as later described, through the blower 40, past heat dissipating plates of the microwave power source 28, and up through side and rear perforations 42*a* and 42*b* respectively in the rear right corner of the top wall extension 14*a*.1 of the top wall 14*a* of the microwave oven cavity 14. Rear and rear side vents having a plurality of holes 44*a* and 44*b* respectively provide for air flow into a horizontal space between the top wall 14*a* of the microwave oven cavity 14 and a grease shield 46. A longitudinally vertical member 48 directs the air flow longitudinally along the rear of the top wall 14*a* from the holes 42*a* and 42*b*, above the extension 14*a*.1 of the top wall 14*a*, past the waveguide 26, past the dome 22, and into the rear and side vent holes 44*a* and 44*b*. A right angle member 44*c* directs the air flow through the rear side holes 44*b* and also serves as a light reflector for a light bulb which is not illustrated for purposes of clarity. Vertical directional vanes 46*a*–46*c* and 46*d* as illustrated in dashed lines extend vertically upward from the grease shield 46 to force the air flow velocity to drive the turbine vane blades 38*a*–38*d* in a counterclockwise direction thereby rotating the directional rotating antenna 32 about the center 22*e* of the dome 22. Air is exhausted out of the space between grease shield 46 and the top wall 14*a* at louvers 46*e* and 46*g*, and louvers 46*f* in the grease shield 46 into the microwave oven cavity 14. A plurality of vent holes 50 in the left front corner of the top wall 14*a* of the microwave oven cavity 14 provide for exhausting of additional air out through the holes 50 in the top wall 14*a*. The upward vertical extending perforated cavity exhaust panel 14*a*.2 of the top wall 14*a* is provided with a plurality of holes 52 which provides for vapors to exhaust through longitudinal louvers 46*h* in the grease shield 46 including a complimentary vertical upwardly extending member 46*i*. Consequently, the air flow velocity exhausts the vapors and moisture out through the front exhaust vent 20.

FIG. 3, which illustrates a section of the present invention taken on line 3—3 of FIG. 2 looking in the direction of the arrows, shows a front view of the top wall 14*a* of the microwave oven cavity 14, the dome 22, the large diameter 22*a*, the angular slope 22*b*, the small diameter 22*c*, the flattened wall 22*d*, and the center of the dome 22*e*, the rectangular transition section 24, the lower junction 24*a*, the upper junction 24*b*, the waveguide 26, the top wall 26*a*, the sidewall 26*c*, the ends 26*d* and 26*e* respectively, the microwave power source 28, the antenna 28*a* for the microwave power source 28, the flanges 30*d* and 30*e*, the directional rotating antenna 32, the end driven half-wavelength resonating elements 32*a* and 32*c*, the support connecting members 32*e* and 32*g*, the parallel plate microstrip transmission line conductors 32*i* and 32*k*, the probe antenna 34, the dielectric bushing 36 in a circular aperture 22*g*, the turbine vanes 38*a* and 38*c*, and the grease shield 46.

Figure 4:
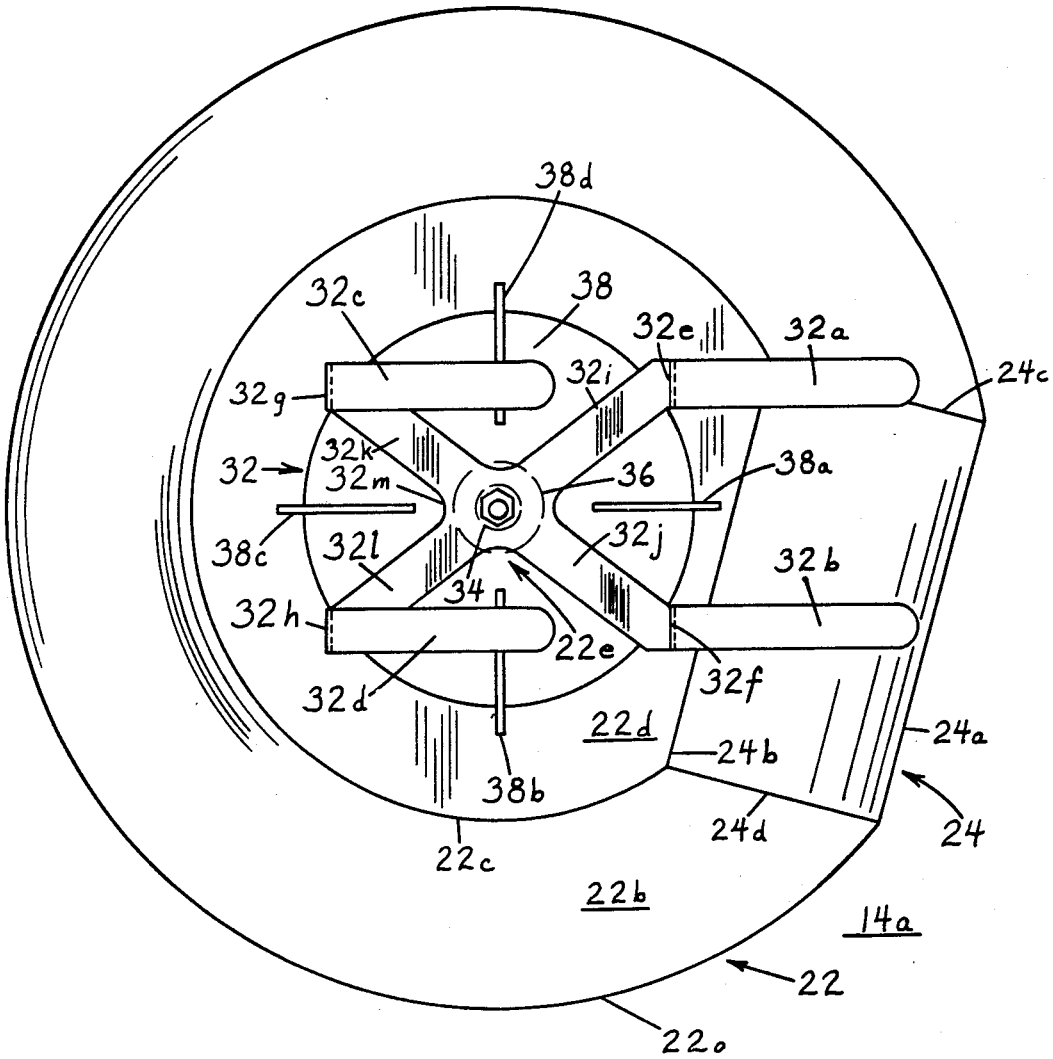
FIG. 4 illustrates a view looking upwards towards a dome in a top wall of the microwave oven.

FIG. 4, which illustrates a view looking upwards at the top wall 14*a* of the microwave oven cavity 14, shows the top wall 14*a*, the dome 22, the large diameter 22*a*, the angular slope 22*b*, the small diameter 22*c*, the flat truncated wall 22*d*, the center of the dome 22*e*, the rectangular transition section 24, the lower junction 24*a*, the upper junction 24*b*, the front taper 24*c*, the back taper 24*d*, the directional rotating antenna 32, the four end driven half-wavelength resonating elements 32*a*–32*d*, the connecting members 32*e*–32*h*, the parallel plate microstrip transmission line conductors 32*i*–32*l*, the center junction 32*m*, the probe antenna 34 in dashed lines, the dielectric bushing 36 in dashed lines, the turbine disc 38, and the turbine vanes 38*a*–38*d*.

Figure 5:
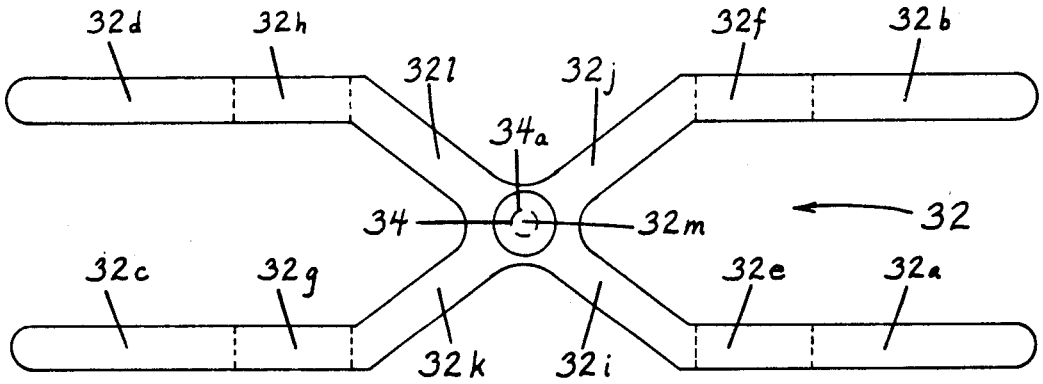
FIG. 5 illustrates a two-dimensional planar layout view of a directional rotating antenna.

FIG. 5, which illustrates a two-dimensional planar layout view of the directional rotating antenna 32 prior to bending the antenna into the three-dimensional form, shows the four end driven half-wavelength resonating elements 32*a*–32*d*, the conductor support members 32*e*–32*h*, the parallel plate microstrip transmission line conductors 32*i*–32*l*, and the junction 32*m* of the parallel plate microstrip transmission line conductors 32*i*–32*l*. The probe antenna 34 having the matching capacitive top hat 34*a* electrically affixes to the common junction 32*m* of the parallel plate transmission line conductors 32*i*–32*l* to excite the directional rotating antenna 32 with microwave energy currents, and physically supports and axially rotates the directional rotating antenna 32. The antenna elements 32*a*–32*d*, the supports 32*e*–32*h*, and the transmission line conductors 32*i*–32*l*, are one-half inch wide by way of example and for purposes of illustration only and are of a suitable thickness of a material such as flat stock, solid round rod, hollow tubing, or flattened hollow tubing of materials such as copper, brass, or aluminum by way of example and for purposes of illustration only. The length of the end driven half-wavelength resonating elements 32*a*–32*d* are one-half wavelength in the embodiment and can be in the range of one-fifth to four-fifths of a wavelength. The spacing between the opposing parallel elements 32*a* and 32*b*, and 32*c* and 32*d* is one-half wavelength in the embodiment and can be in the range of two-tenths to eight-tenths of a wavelength. The spacing between common points of the end-to-end elements 32*a* and 32*c*, and 32*b* and 32*d* is three-quarters wavelength in the embodiment and can be in the range of three-tenths to one and four-tenths wavelength. The height of the support conductors 32*e*–32*h* is predetermined so that the spacing between the antenna elements 32*a*–32*d* and the flat truncated wall 22*d* of the dome 22 is one-quarter wavelength in the embodiment and can be in the range of one-tenth to four-tenths wavelength. The support conductors can also be inclined in the range of zero to sixty degrees from the vertical axis. The length of the transmission line conductors 32*i*–32*l* from the junctions 32*m* to the support members 32*e*–32*h* is determined by the spacing of the antenna elements 32*a*–32*d* in the embodiment. Differential lengths of transmission line conductors 32*i*–32*l* in the range of zero to three-tenths wavelength with respect to a junction 32*m* can be utilized. The end radius of the antenna elements 32*a*–32*d* is determined by the width of the elements 32*a*–32*d* for ease of manufacture. The radii at the junctions between the elements and the supports and the supports and the microstrip transmission line is predetermined for ease of assembly.

Figure 6:
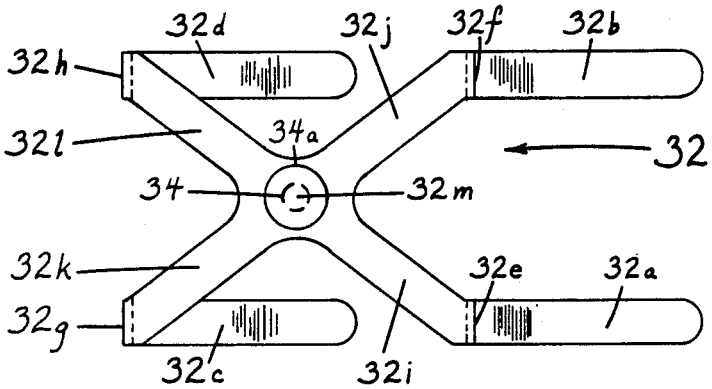
FIG. 6 illustrates a top view of the three-dimensional direction rotating antenna.

FIG. 6 illustrates a top view of the three-dimensional directional rotating antenna 32 formed from the two-dimensional flat plan view structure of FIG. 5 as described in the preceding paragraph. The resonating antenna elements 32*a*–32*d* in the embodiment are in a two-by-two planar array with respect to the top wall 22*d* of the dome 22 and can be at an angle of inclination in the range of zero to fifty degrees with respect to the plane. All numerals correspond to those elements previously delineated.

Figure 7:
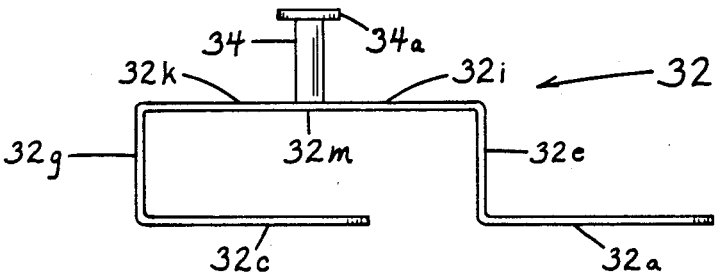
FIG. 7 illustrates a side view of the directional rotating antenna of FIG. 6.

FIG. 7 illustrates a side view of the directional rotating antenna 32 where all numerals correspond to those elements previously delineated.

Figure 8:
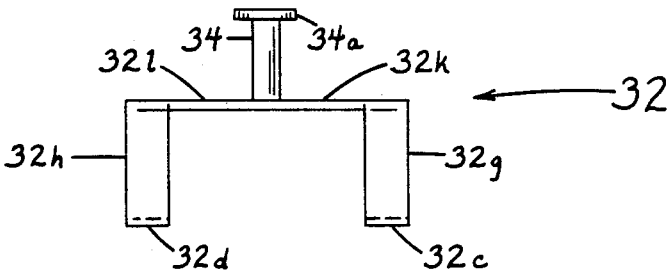
FIG. 8 illustrates an end view of the directional rotating antenna of FIG. 6.

FIG. 8 illustrates an end view of the directional rotating antenna 32 where all numerals correspond to those elements previously delineated.

Figure 9:
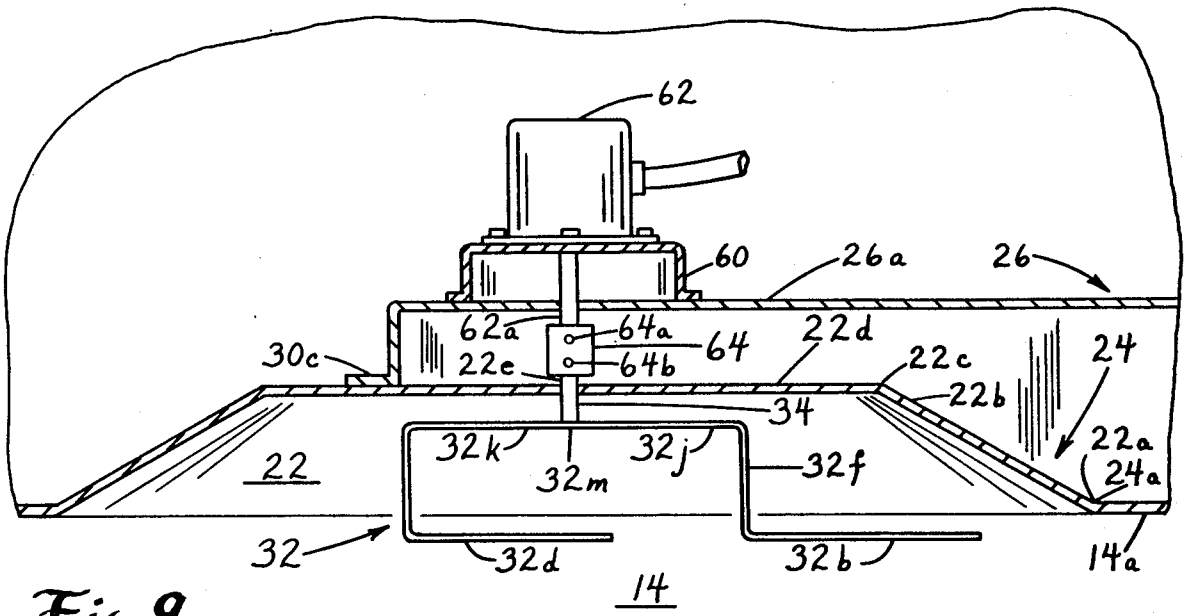
FIG. 9 illustrates a vertical sectional view of another embodiment of a directional rotating antenna.

FIG. 9, which illustrates a vertical sectional view of another embodiment for rotating the directional rotating antenna 32, shows a motor housing 60 affixed to the top wall 26*a* of the waveguide 26 and supports an electrical motor 62 having a dielectric shaft 62*a* which extends through the motor housing support 60 and through the top wall of the waveguide 26*a*. A dielectric shaft coupling 64 having set screws 64*a* and 64*b* couples the motor shaft 62*a* to the probe antenna 34. The structure of the top wall 14*a*, the dome 22, the waveguide 26 is identical to that structure previously delineated, especially for FIG. 3. While the motor shaft 62*a* of the motor 62 is illustrated as being axially aligned with the probe antenna 34, the motor shaft 62*a* can utilize mechanical transmission components such as gears, belts, chains, flexible shafts or eccentric rods by way of example and for purposes of illustration only.

Figure 10A:
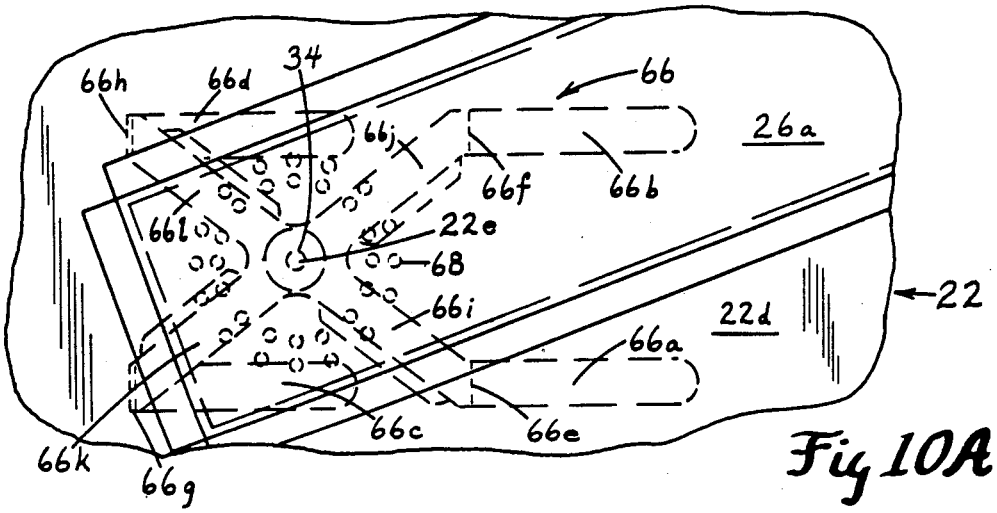
FIG. 10A illustrates a top view of an additional embodiment of a directional rotating antenna.
Figure 10B:
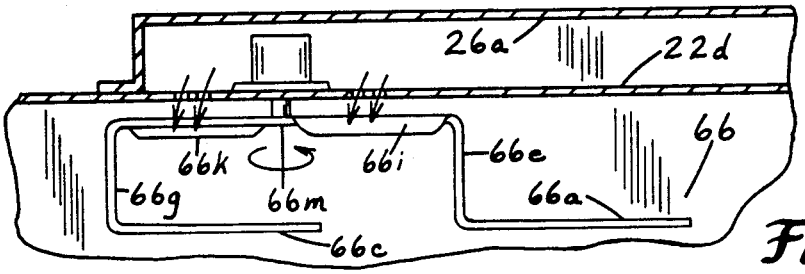
FIG. 10B illustrates a vertical sectional view of the additional embodiment of the directional rotating antenna.

FIG. 10A, which illustrates a top view of an additional embodiment of a directional rotating antenna 66, shows four end driven half-wavelength resonating elements 66*a*–66*d*, vertical support members 66*e*–66*h* connected to each of the antenna elements 66*a*–66*d*, and microstrip transmission line conductors 66*i*–66*l* connected to each of the vertical support members 66*e* –66*h* and joined at a common junction 66*m* illustrated in FIG. 10B. The microstrip transmission line conductors 66*i*–66*l*, opposed to being parallel to the top wall 22*d* of the dome 22 as illustrated in FIGS. 1–9, are angled in a range of fifteen to seventy-five degrees and perform as turbine blades as now described in addition to being microstrip parallel plate transmission line conductors 66*i*–66*l*. A plurality of holes 68 are positioned about the center 22*e* in the flat truncated top wall 22*d* of the dome 22. Air is introduced through a plurality of holes not illustrated in the end 26*d* of the waveguide for purposes of clarity in the illustration from the vent holes 42*a* and 42*b* of FIG. 2 so that the air flows the longitudinal length of the waveguide 26 and down through the holes 68 in the wall 22*d* to drive the directional rotating antenna 66 in a turbine pinwheel like manner about the center axis 22*e* of the dome 22.

FIG. 10B illustrates a vertical sectional view of FIG. 10A where all numerals correspond to those elements previously delineated.

Figure 11A:
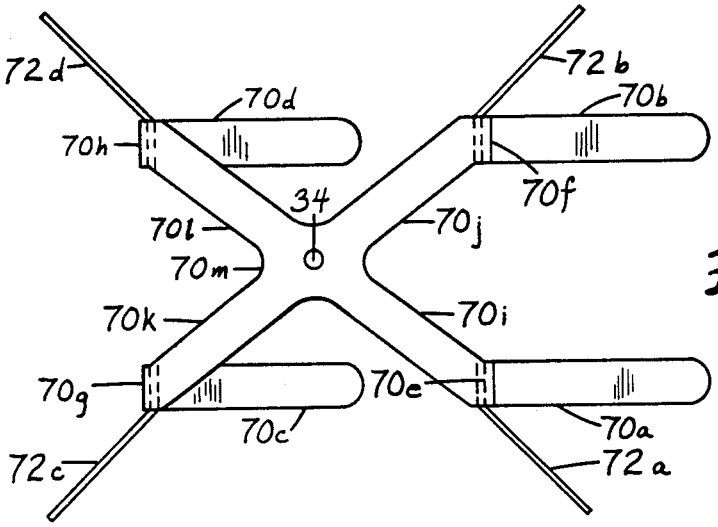
FIG. 11A illustrates a top view of a further embodiment of a directional rotating antenna.

FIG. 11A, which illustrates a top view of a further embodiment of a directional rotating antenna 70, shows four end driven half-wavelength resonating elements 70*a*–70*d*, vertical support members 70*e*–70*h* connected to each of the antenna elements 70*a*–70*d*, and parallel plate microstrip transmission line conductors 70*i*–70*l* connected to each of the vertical support members and joined at a common junction 70*m*. The probe antenna 34 connects to the common junction 70*m*. Turbine vane blades 72*a*–72*d* suitably affix between each of the elements 70*a*–70*d* and the vertical support members 70*e*–70*h* at an angle in the range of twenty to seventy degrees and at forty-five degrees as illustrated in this embodiment. The blades 72*a*–72*d* can be dielectric material wrapped or frictionally engaged about the vertical support members 70*e*–70*h* or in the alternative, can be metallic vanes affixed in a manner to minimize any effect on the antenna pattern of the directional rotating antenna 70.

Figure 11B:
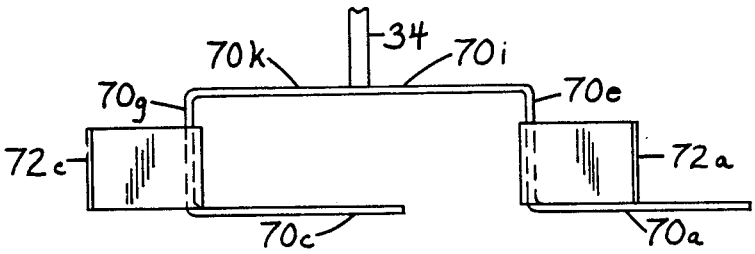
FIG. 11B illustrates a front view of the further embodiment of the directional rotating antenna.

FIG. 11B illustrates a front view of FIG. 11A where all numerals correspond to those elements previously delineated.

FIG. 12A, which illustrates a top view of still an additional embodiment of a two element directional planar array rotating antenna 74, shows a first end driven half-wavelength element 74*a* and a second end driven wavelength element 74*b*, vertical support members 74*c* and 74*d* perpendicular to the top flattened dome wall 22*d* which is not illustrated and parallel plate microstrip transmission line conductors 74*e* and 74*f*. The length of the microstrip transmission line conductor 74*e* is one-eighth wavelength and the length of the microstrip transmission line conductor 74*f* is three-eighths wavelength. The element 74*a* is one-quarter wavelength closer to the source 74*g* of the microwave energy currents than elements 74*b*, and therefore, leads in phase element 74*b* by ninety degrees. The element 74*b* is at an angle of ninety degrees to element 74*a* resulting in the fact that the elements 74*a* and 74*b* are in phase and angle quadrature.

FIG. 12B illustrates a front view of FIG. 12A where all numerals correspond to those elements previously delineated.

FIG. 13A, which illustrates a top view of still another embodiment of a two element planar array directional rotating antenna 76, an alternative embodiment of the antenna 74 illustrated in FIGS. 12A and 12B, shows an end driven half-wavelength resonating element 76*a* and a second end driven half-wavelength resonating element 76*b*, vertical supports 76*c* and 76*d*, and microstrip parallel plate transmission line conductors 76*e* and 76*f* of one-eighth and three-eighths wavelength long respectively joined at a common point 76*g* where the probe antenna 34 (not shown) connects. The angle between the elements 76*a* and 76*b* is ninety degrees but the angles of the elements 76*a* and 76*b* with respect to the conductors 76*e* and 76*f* are determined by the fact that the distance from the common junction 76*g* of the microstrip parallel plate transmission line conductors 76*e* and 76*f* is one-quarter wavelength farther to the center point of the one antenna than the other antenna. Restating this numerical relation, the distance from the center 76*a* to 76*g* plus one-quarter wavelength is equal to the distance from the center 76*b* to 76*g*. In this embodiment, element 76*a* is one hundred twenty-nine degrees to conductor 76*e* and element 76*b* is one hundred forty-one degrees to conductor 76*f*.

FIG. 13B illustrates a front view of FIG. 13A where all numerals correspond to those elements previously delineated.

Figure 14A:
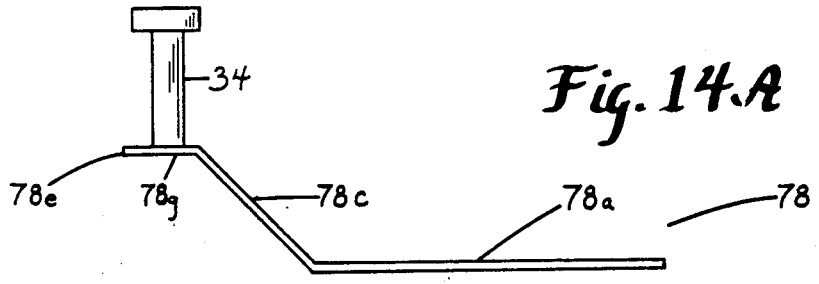
FIG. 14A illustrates a side view of a still further embodiment of a directional rotating antenna.
Figure 14B:
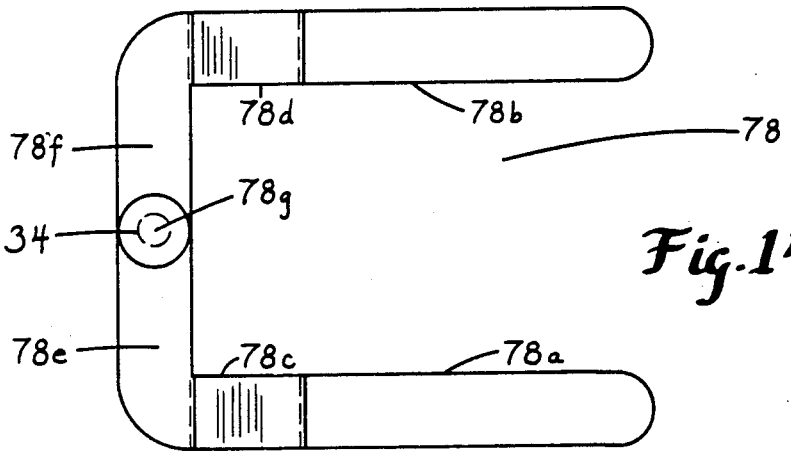
FIG. 14B illustrates a top view of the still further embodiment of the directional rotating antenna.

FIG. 14A, which illustrates a side view of a still further embodiment of a two element planar directional rotating antenna 78, shows parallel end driven half-wavelength resonating elements 78*a* and 78*b* in FIG. 14B, angled support conductors 78*c* and 78*d* in FIG. 14B, and microstrip parallel plate transmission line conductors 78*e* and 78*f* joined at a common junction 78*g* *where the probe antenna 34 connects. The distance of the transmission line conductors and the support conductors 78c* and 78*e*, and 78*d* and 78*f* is in the range of one-half wavelength.

FIG. 14B illustrates a top view of the still further embodiment of the directional rotating antenna 78.

Figure 15A:
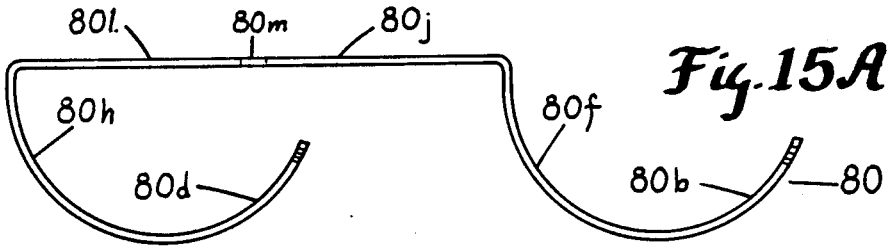
FIG. 15A illustrates a side view of still another embodiment of a directional rotating antenna.
Figure 15B:
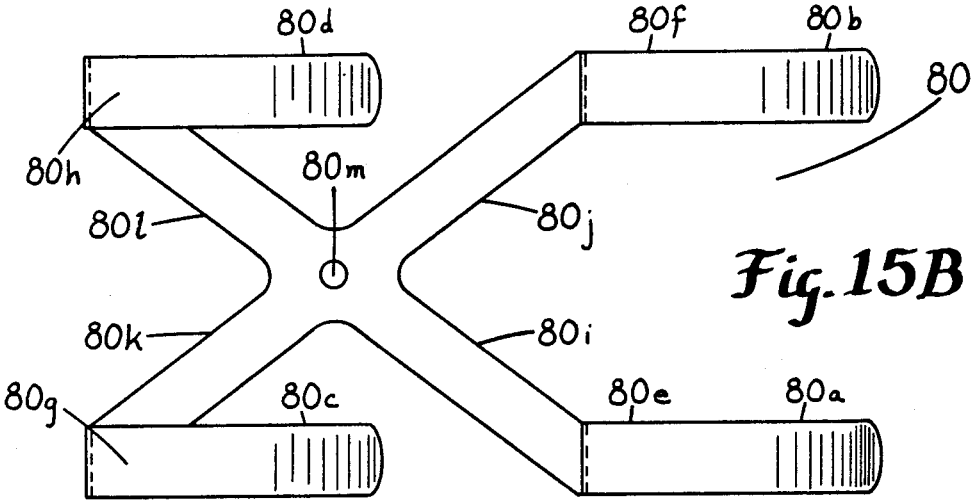
FIG. 15B illustrates a bottom view of still another embodiment of the directional rotating antenna.

FIG. 15A, which illustrates a side view of still another embodiment of a two-by-two directional rotating antenna array 80, shows four end driven half-wavelength arc-shaped resonating elements 80*a*–80*d*, each equally curved about a parallel horizontal axis, 80*b* and 80*d* illustrated in FIG. 15B; support conductors 80*e*–80*h* connected to each of the respective elements 80*a*–80*d*, 80*f* and 80*h* illustrated in FIG. 15B; and, microstrip parallel plate transmission line conductors 80*i*–80*l*, 80*j* and 80*l* illustrated in FIG. 15B connected to the support conductors 80*e*–80*h* and joined at a common junction 80*m*.

FIG. 15B illustrates a bottom view of still another embodiment of the directional rotating antenna 80.

Figure 20:
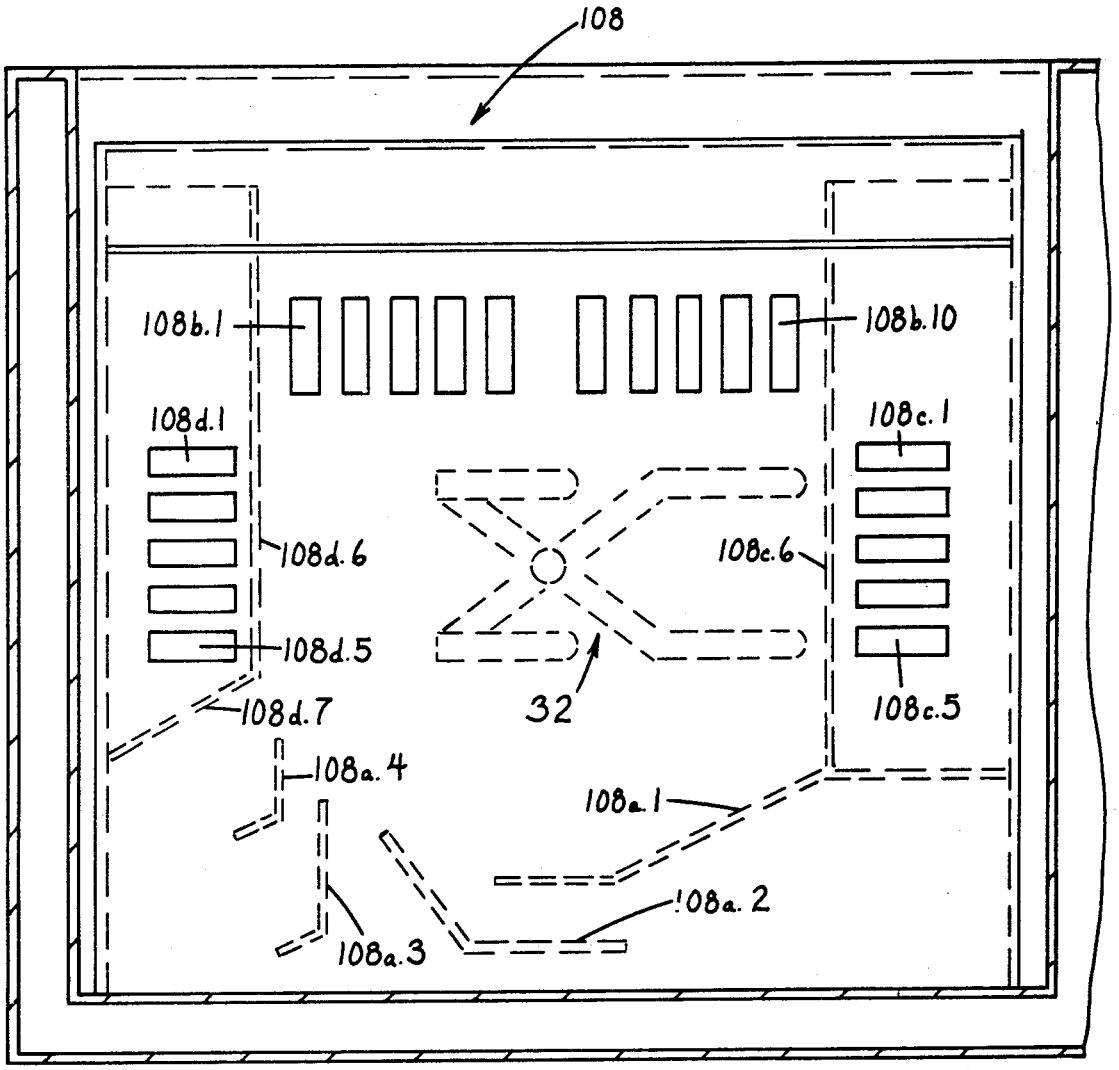
FIG. 20 illustrates a section of the present invention taken on line 20—20 of FIG. 18 looking in the direction of the arrows and shows a bottom view of the grease shield.

FIG. 16, which illustrates a front perspective view of another embodiment of a microwave oven 100, without a grease shield 108 illustrated in FIGS. 19 and 20 in position, shows a three-sided housing cover 102*a*–102*c*, side 102*c* not being shown, and a microwave oven cavity 104 including a top wall 104*a*, a bottom wall 104*b* not illustrated in the figure, a left sidewall 104*c*, a right sidewall 104*d*, a rear wall 104*e*, a left sloping wall 104*a*.1 and a right sloping wall 104*a*.2 connected between the top wall 104*a* and the respective vertical walls, and upwardly extending vertical front wall 104*a*.3 recessed towards the rear wall 104*e* of the oven. The directional rotating antenna 32 axially mounts in the top wall 104*a* of the microwave oven cavity 100 as previously described in FIGS. 1–8. The turbine vane assembly is not illustrated in the figures for the sake of clarity.

Figure 17:
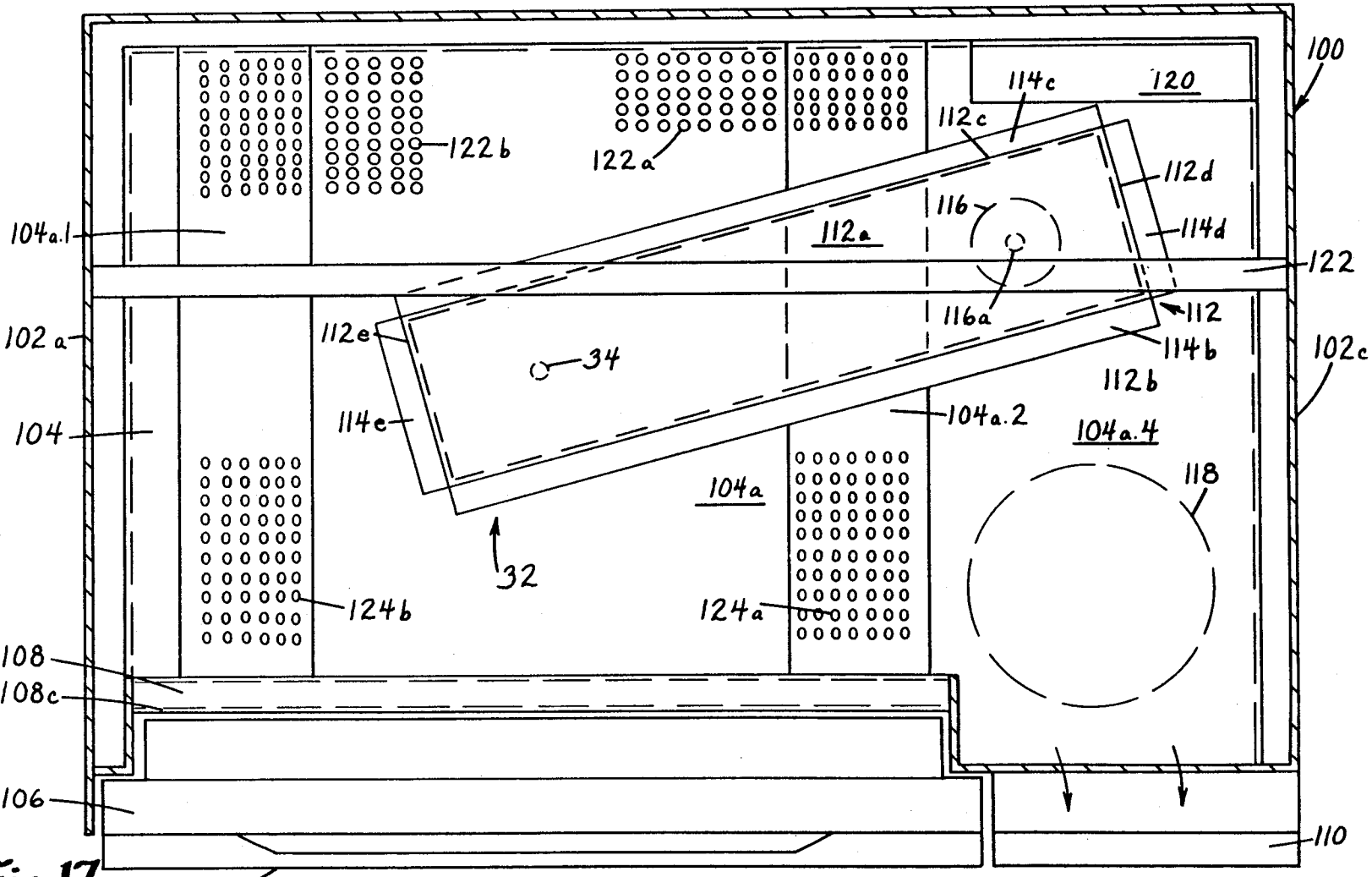
FIG. 17 illustrates a section of the present invention taken on the line 17—17 of FIG. 16 looking in the direction of the arrows and shows a top view of the microwave oven.

FIG. 17, which illustrates a section of the present invention taken on line 17—17 of FIG. 16 looking in the direction of arrows, shows a top view of the microwave oven 100. A door 106 hinged on the bottom and having a handle 106*a* fits in between the walls 104*a*–104*d* not illustrated in the figure of the cavity 104 and closes adjacent to the grease shield 108. An exhaust vent 110 positions on the front of the top wall extension 104*a*.4 to exhaust cooking vapors and moisture as later described in detail. A waveguide 112 having a top wall 112*a*, sidewalls 112*b* and 112*c*, and end walls 112*d* and 112*e* fastens to the top wall 104*a*, the slope 104*a*.2, and the top wall extension 104*a*.4 such as by spot welding the extending flanges 114*b*, 114*c*, 114*d* and 114*e* respectively. The waveguide 112 couples energy from a microwave power source 116 having an antenna 116*a* extending into the waveguide 112 to a probe antenna 34 extending between the microwave oven cavity 104 and the waveguide 112 and connected to the directional rotating antenna 32, not shown. A blower 118 illustrated in dashed lines brings air in through a plurality of holes in the bottom of the microwave oven 100, past the power supply components, past the microwave energy source 116 and up through a vent hole 120 as previously described for FIGS. 1–8. The air flow velocity is forced along the top rear of the microwave oven 100 between the rear wall of the housing and the longitudinally extending member 122 which extends along the top wall extension 104*a*.4, over the waveguide 112, over the slope 104*a*.1 to the left side of the housing 102*a*. The air vents down into the microwave oven cavity through the vent holes 122*a* and 122*b*. Directional vanes 108*a*–108*a*.4 of FIGS. 19 and 20 extending vertically upward from the grease shield 108 result in air velocity to rotate the directional rotating antenna 32 in a counterclockwise direction as previously described. The air exhausts into the microwave oven cavity through the holes 108*b*.1–108*b*.10 in the grease shield 108 in front of the door 106 as illustrated in FIG. 19, circulates past the door 106, around the inside of the microwave oven cavity 104, exits out through holes 108*c*.1–108*c*.5 and 108*d*.1–108*d*.5 in the grease shield, and through vent holes 124*a* and 124*b* in the slope walls 104*a*.2 and 104*a*.1 respectively. Upwardly extending members 108*c*.6, 108*c*.7, 108*d*.6 and 108*d*.7 separate the incoming and outgoing air through the grease shield 108. The moisture and vapors in the air subsequently flow out through the exhaust vent 110.

FIG. 18, which illustrates an upper front view of the microwave oven 100, shows the grease shield 108 positioned below the top wall 104*a*, and the sloping walls 104*a*.1 and 104*a*.2. An upper vertical member 108*e* of the grease shield 108 extends over the front verticall wall 104*a*.3 shown in FIG. 16. All numerals correspond to those elements previously delineated.

FIG. 19, which illustrates a section of the present invention taken on line 19—19 of FIG. 18 looking in the direction of the arrows, shows a top view of the grease shield 108. Holes 108*c*.1–108*c*.5 and 108*d*.1–108*d*.5 provide for exhausting air out of the cavity through the holes up through air vents 124*a* and 124*b* as shown in FIG. 17. Vertical dividers 108*c*.6 and 108*c*.7 and 108*d*.6 and 108*d*.7 provide for separating the incoming air flow from the outgoing air flow. Vertical members 108*a*.-1–108*a*.4 direct the air flow to drive the turbine vanes not illustrated in the figure supported on the directional rotating antenna 32 in a counterclockwise direction likewise rotating the antenna 32 as previously described.

FIG. 20, which illustrates a section of the present invention taken on the line 20—20 of FIG. 18 looking in the direction of the arrows, shows a bottom view of the grease shield 108. All numerals correspond to those elements previously delineated.

Figure 21:
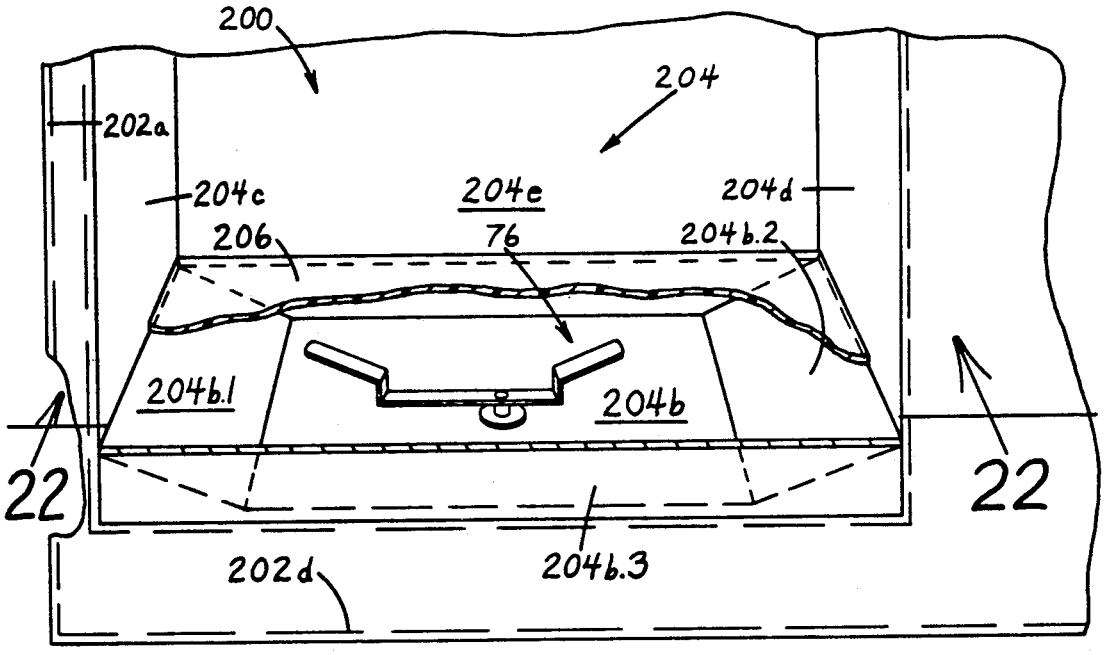
FIG. 21 illustrates a front perspective view of a further embodiment, partially cutaway, of a bottom feed microwave oven utilizing the antenna of FIGS. 13A and 13B; and, FIG. 22 illustrates a section of the present invention taken on line 22—22 of FIG. 21 looking in the direction of the arrows.
Figure 22:
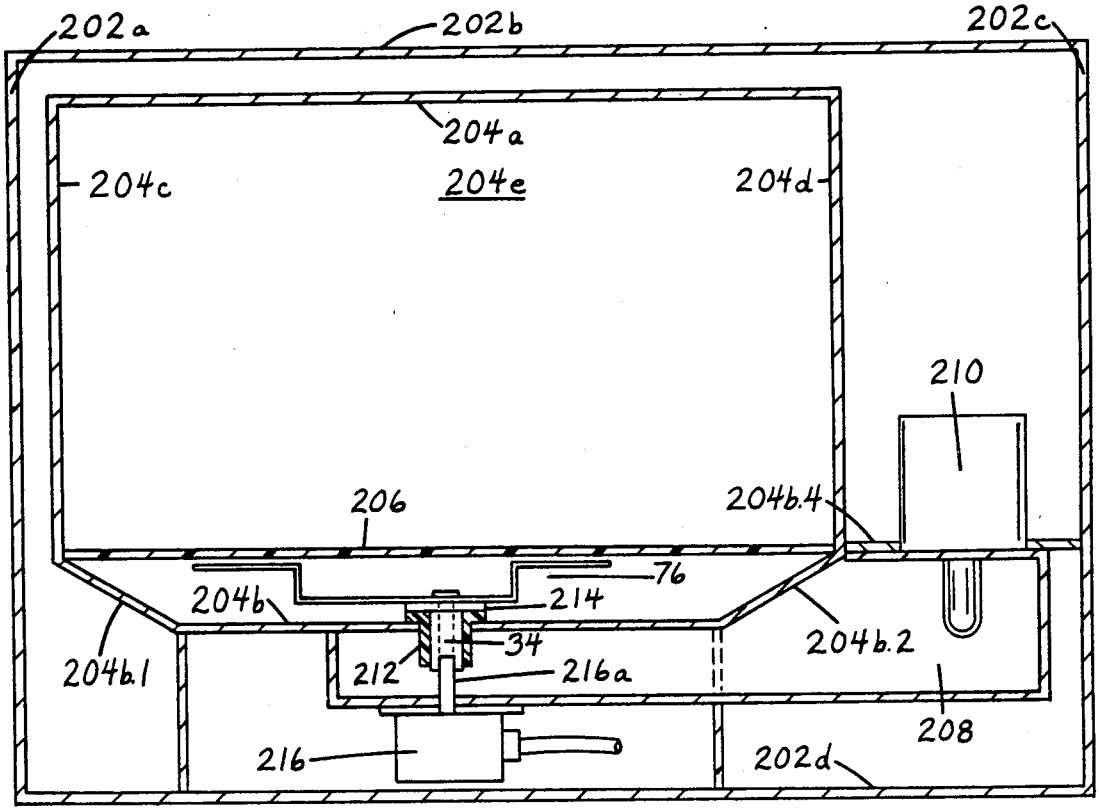

FIG. 21 illustrates a front perspective view of a further embodiment, partially cutaway, of a bottom feed microwave oven 200 utilizing the two element rotating directional antenna 76 of FIGS. 13A and 13B. A three-sided housing cover 202*a*–202 *c* as best illustrated in FIG. 22 surrounds a base 202*d* and encloses the microwave oven 200. A five-sided conductive microwave oven cavity 204 includes a top wall 204*a* illustrated in FIG. 22, a bottom wall 204*b*, a left sidewall 204*c*, a right sidewall 204*d*, a rear wall 204*e*, a left bottom sloping wall 204*b*.1 and a right bottom sloping wall 204*b*.2 connected between the bottom wall 204*b* and the respective vertical walls 204*c* and 204*d*, and an upwardly extending front vertical wall 204*b*.3. The directional rotating antenna 76 axially mounts in the bottom wall 204*b* as later described in FIG. 22. A conductive door not illustrated in the figure for the sake of clarity comprises the sixth conductive side of the cavity 204 and encloses the microwave oven cavity 204. A glass panel 206 transparent to microwave energy may be supported at the junction of the sloping walls 204*b*.1 and 204*b*.2, the vertical walls 204*c* and 204*d*, and rest on an indentation in the upwardly extending front vertical wall 204*b*.3.

FIG. 22, which illustrates a vertical sectional view of the present invention taken on the line 22—22 of FIG. 21, looking in the direction of the arrows, shows a waveguide 208 having three sides which fasten to the bottom wall 204*b*, the right sloping wall 204*b*.2 and a bottom wall extension 204*b*.4 such as by welding. The waveguide 208 couples energy from a microwave power source 210 to the probe antenna 34 extending partially into the waveguide 208 as now described. An outer flange 212 of dielectric material such as tetrafluoroethylene including a longitudinal hole extending therethrough is accommodated in an aperture of like diameter in the bottom wall 204*b*. A corresponding inner flange 214 of like material having an outer diameter corresponding to the inner diameter of the longitudinal hole axially mounts therein. A longitudinal hole in the inner flange 214 accommodates the diameter of the probe antenna 34 and supports the same in addition to engaging a dielectric shaft 216*a* of a motor 216 which affixes to the waveguide with the dielectric shaft 216*a* extending through an aperture in the waveguide 208.

PREFERRED MODE OF OPERATION

FIGS. 1–8 disclose one mode of operation of one embodiment of the present invention of the microwave oven 10.

The top wall 14*a* of the microwave oven cavity 14 includes a dome 22 formed in and extending above the top wall 14*a*, and an extension 14*a*.1 to serve as a mounting wall support for the microwave power source 28 where the dome 22, transition 24, and extension 14*a*.1 is the fourth side for the three-sided waveguide 26 attached to the outside of the top wall 14*a* of the microwave oven cavity.

The shape of the dome 22 is a truncated flattened conical shape except for the rectangular transition section 24 which serves as a taper transition for the waveguide impedance and is substantially a half-wavelength long in joining the waveguide at the microwave power source 28 to the reduced height waveguide above the flattened top wall 22*d* of the dome 22. The dome 22 can be truncated at any angle to the top wall 14*a*. This rectangular transition section 24 also simplifies construction of mounting flanges on the waveguide 26 in that the mounting flanges are planar. The rectangular transition section 24 could also be eliminated and the impedance transition function can also be performed by joining the waveguide 26 to the conical surface of the dome 22. The waveguide 26 is a one-by-two dimension in the full height section at the microwave power source 28 to excite the dominant $TE_{10}$ mode over a broad frequency range. Energy is coupled from the antenna 28*a* of the microwave power source 28 such as a magnetron through the waveguide 26 to the probe antenna 34 connected to the directional rotating antenna 32. The dome 22 provides a nearly circular recess partially surrounding the directional rotating antenna 32. The dome 22 also provides a uniform energy distribution by partially surrounding the directional rotating antenna 32 with stable reflections as the directional rotating antenna 32 rotates about the center axis of the dome 22. The angular slope 22*b* returns microwave energy reflected from the product being heated in the microwave oven cavity 14 such as food back towards a circular area in the middle of the microwave oven cavity 14*a* which further aids in uniform energy distribution.

The dome 22 in the top wall 14*a* of the microwave oven cavity 14 provides for utilization of an antenna, including the disclosed antennas of the present invention, with a directional radiation pattern. This significantly results in the microwave energy reaching the product over a fraction of the product's area at any given instant of time. The location of the directional rotating antenna 32 in the dome and the radiation pattern of the antenna 32 provides a circularly symmetric and consistent distribution of microwave power in the food product. In cooking large volume loads, a radiation pattern with an increase of central intensity is desirable. Utilization of the directional rotating antenna 32 is desirable to reduce interference between the direct waves and those reflected waves from the sidewalls by minimizing the power radiated towards the sidewalls. The structure of the dome 22 also aids in directing the air stream to rotate the turbine vane structure 38 affixed to the directional rotating antenna 32. The structure of the dome 22 further simplifies construction of the microwave oven 10 in that only two sheet metal parts are required to form the top wall of the microwave oven cavity including the microwave energy power source support, the air baffle, and the blower support, and the three-sided waveguide. Most importantly, the sheet metal parts are arranged for utilization with automatic resistance spot welding equipment. The waveguide height above the dome 22 and the probe antenna 34 of the directional rotating antenna 32 results in a vertical height which is minimal, especially compared to the prior art microwave ovens, and provides a larger microwave oven cavity 14 for the identical exterior housing dimensions.

The directional rotating antenna 32 includes a two-by-two array of four end driven half-wave elements 32*a*–32*d*, the elements being positioned approximately one-quarter wavelength from the top wall of the microwave oven cavity and separated between the elements 32*a* and 32*b*, and 32*c* and 32*d* by a distance of one-half wavelength. The probe antenna 32 connects to the common junction 32*m* and serves as a rotating joint providing microwave currents to the directional rotating antenna 32 at all angles of rotation. The directional radiation characteristics of the directional rotating antenna 32 result from the configuration of the four end driven half-wavelength elements 32*a*–32*d* and are further enhanced by the reflections from the top cavity wall 22*d* in the dome 22. The half-wavelength resonating elements 32*a*–32*d* are end fed which results in a single conductor serving as a support, as a transmission line, and at the end, as a radiator. The directivity of short conducting elements improves as the length increases, but the longest element in which all current is in the same direction is one-half wavelength long. Perpendicular radiation from elements longer than one half-wavelength diminishes due to current reversal.

The electromagnetic fields of the four end driven half-wavelength elements 32*a*–32*d*, and the reflections and images in the top wall 14*a* and sidewalls 14*b*–14*e* add together constructively in a direction along the center axis of the antenna 32. The electromagnetic fields diminish due to the changes of the phase relations for points away from the center axis. The electromagnetic E field from the antenna is described as being directed downwardly in a vertical direction and diminishing at angles towards the edges of the microwave oven 10.

The four end driven half-wavelength elements 32*a*–32*d* of the directional rotating antenna 32 are supported by the vertical conductors 32*e*–32*h* perpendicular to the top wall 14*a* and 22*d* of the microwave oven cavity 14 and the dome 22. The microstrip parallel plate transmission feed line conductors 32*i* –32*l* extend from the common junction 32*m* in the center 22*e* of the dome 22 of the vertical support conductors 32*e*–32*h*. The conductors of the microstrip parallel plate transmission line conductors 32*i*–32*l* between the central junction 32*m* and the vertical supports 32*e*–32*h* are relatively close to the flattened top wall 22*d* of the dome 22 to constitute the air dielectric microstrip transmission line. While there is some finite radiation from the microstrip transmission lines 32*i*–32*l*, the radiation is substantially less than that of the elevated four end driven half-wavelength resonating elements. A probe antenna 32 which connects to the common junction 32*m* of the antenna 32 extends partially into the waveguide 26 and is excited by microwave currents.

Each of the four end driven half-wavelength elements 32*a*–32*d* of the directional rotating antenna 32 functions as a combined transmission line and long wire antenna. Radio frequency currents form a standing wave on each element with zero current at the projecting end which has a radius equal to half of the width of the element. A maximum current appears a quarter-wavelength away near the center of the radiating element. The next minimum of current appears near the top of the vertical support. The currents on the vertical support radiate radio frequency electromagnetic wave energy perpendicular to the desired direction. The radiating elements can be made shorter than a half-wavelength as previously discussed in FIG. 5 and then the minimum current is positioned on the vertical support conductor and the perpendicular radiation is minimized.

The opposing end driven half-wavelength elements 32*a* and 32*b*, and 32*c* and 32*d* are located a half-wavelength apart and radiate horizontally polarized E fields. The horizontal directed E field component of the electromagnetic wave energy which travels from the element 32*a*–32*d* towards the sidewalls are cancelled. Likewise, little radiation is emitted off the ends of the elements 32*a*–32*d* towards the sidewalls. This reduction of field excitation and cancellation of the horizontal directed E field component towards the nearest portion of the sidewalls reduces reflection back towards the antenna 32 from the sidewalls, and thus reduces the perturbation of antenna impedance by the sidewall reflections. This enhances the antenna impedance uniformity contributing to the uniform energy radiation pattern as the directional rotating antenna 32 is rotated about a circular axis on the center of the cavity. The three-quarter wavelength spacing between elements 32*a* and 32*c*, and 32*b* and 32*d* positioned end-to-end enhances off axis electromagnetic fields.

The antenna is rotated about its center axis in the microwave oven cavity in the range of forty to one hundred and fifty revolutions per minute depending upon the velocity of air flow between the top wall 14*a* of the microwave oven cavity and the grease shield 46 acting against the turbine vane assembly 38. A desirable rotation for the directional rotating antenna 32 about the center axis of the microwave oven cavity 14 is one hundred revolutions per minute.

FIG. 9 illustrates an alternative embodiment for rotating the directional rotating antenna 32 where the antenna is rotated by the electric motor 62 opposed to FIGS. 1–3 where the antenna is rotated by moving stream of air acting against the turbine vane assembly 38.

FIGS. 10 and 11 illustrate alternative embodiments of directional rotating antennas 66 and 70 respectively where FIG. 10 illustrates the turbine vane structure 66*i*–66*l* incorporated into the microstrip transmission lines of the directional rotating antenna 66 and FIG. 11 illustrates vanes 72*a*–72*d* attached directly to the antenna opposed to the disc 38 supporting turbine vane elements 38*a*–38*d*. The vane elements 72*a*–72*d* attach directly to the antenna 70 can either be dielectric material or metal material suitably positioned so that the metal vanes do not distort the effect of the main antenna pattern.

FIGS. 12 and 13 illustrate alternative embodiments of directional rotating antennas 74 and 76 which can be utilized with the dome 22 of FIGS. 1–8 and which exhibit directional patterns, although the directional patterns are not as directional as the directional rotating antenna 32 of FIGS. 1–8. While the additional power reaching the sidewalls results in increased interference patterns, the antennas 74 and 76 provide two elements at different radii in order to smooth interference patterns.

FIGS. 14 and 15 illustrate other alternative embodiments of directional rotating antennas 78 and 80. FIG. 14 illustrates the two element directional rotating array 78. FIG. 15 illustrates a two-by-two directional rotating antenna having curved radiating elements 80*a*–80*d*.

FIGS. 16–20 illustrate an additional embodiment of the microwave oven cavity 104 which has construction of rectangular components. Any directional rotating antenna of the present invention can be utilized within the microwave oven cavity 104, especially the directional rotating antenna 32 of FIGS. 6–8 where the narrow directional pattern is less perturbed by the absence of the circular dome. The microwave cavity 104 has less central concentration of energy than the microwave cavity 14 because the focusing of reflections from the food is a linear and uniform distribution of microwave energy along the center line from the front to the back of the microwave oven cavity 104.

FIGS. 21 and 22 illustrate a further embodiment of the bottom feed microwave oven cavity 204 which has construction of rectangular components. While any directional rotating antenna of the present invention can be utilized within the microwave oven cavity 204, the directional rotating antenna 76 is particularly lended to a uniform energy distribution and consistent heating pattern in the bottom feed microwave oven 200.

Various modifications can be made to the microwave oven of the present invention without departing from the apparent scope thereof.

The dome 22 of FIGS. 1–8 can be situated on the bottom wall of the microwave oven cavity and the product such as food can be placed near the directional rotating antenna supported on a shelf such as glass transparent to the microwave energy. Any of the directional rotating antennas can be utilized since the microwave energy goes more directly to the product with little reflection from the microwave cavity walls. The symmetry of the dome aids in uniformity with the stability of the antenna impedance and by reflecting the microwaves towards the center of the microwave oven cavity. The three-sided waveguide can be affixed directly to the conical shaped dome in the absence of the transition section. While the dome has been disclosed as being a flattened truncated conical shaped dome, the dome can be flattened or truncated in any geometrical manner and can be positioned on any of the six walls of the microwave oven cavity.

The various lengths and angle of the elements, supports, and conductors of the directional rotating antenna of FIGS. 6–9 also apply to the directional rotating antennas of FIGS. 10–15 inclusive. While the elements have been driven from corresponding ends, the elements can also be fed at opposite ends by transmission lines of unequal length in the range of one-quarter to three-quarters wavelength.

Having thus described the invention, what is claimed is:

1. Directional rotating antenna for use in a microwave heating cavity comprising:

a. a probe antenna extending through an aperture in a surface of said cavity for receiving microwave energy in a waveguide and coupling it into said cavity, said probe antenna being substantially perpendicular to said surface;

b. a transmission line conductor connected to said probe antenna within said cavity, said transmission line conductor being adjacent and substantially parallel to said surface;

c. first and second conductor legs respectively connected to the ends of said transmission line conductor, said legs extending inwardly to said cavity away from said surface;

d. first and second antennas respectively connected to the inwardly extending ends of said first and second conductor legs, said first and second antennas being substantially parallel to said surface; and e. means to axially rotate said probe antenna whereby said first and second antennas radiate microwave energy in said cavity with uniform energy distribution.

2. The directional rotating antenna of claim 1 wherein said transmission line conductor comprises first and second transmission lines of one-eighth and three-eighths wavelengths respectively, said first and second conductor legs comprise quarter-wavelength vertical support conductors, and said first and second antennas comprise half-wavelength antenna elements positioned at right angles to each other.

3. The directional rotating antenna of claim 1 wherein said first and second antennas comprise half-wavelength antenna elements and are spaced approximately one-quarter wavelength from said surface.

4. The directional rotating antenna of claim 3 wherein said first antenna is orthogonal to said second antenna.

5. A microwave oven for heating product with uniform energy distribution, comprising:

a. a microwave oven cavity having an aperture in the floor and an access opening in the front;

b. a door for enclosing said access opening;

c. a magnetron;

d. a waveguide positioned below said floor for coupling microwave energy from said magnetron to said aperture;

e. a directional antenna including a probe antenna axially supported through said aperture for receiving microwave energy in said waveguide and coupling it through said aperture to said directional antenna, said directional antenna comprising a transmission line conductor slightly spaced and substantially parallel to a portion of said floor surrounding said aperture, conductor legs extending from the ends of said transmission line conductor inwardly away from said floor, and radiating elements connected to said legs wherein said radiating elements are spaced approximately one-quarter wavelength from said floor portion and substantially parallel thereto; and f. means for axially rotating said directional antenna about said probe antenna.

6. The microwave oven of claim 5 wherein there are two of said conductor legs and the difference in the distances from said probe antenna to said respective two conductor legs is one-quarter wavelength.

7. The microwave oven of claim 6 wherein there are two radiating elements that are perpendicular to each other.

* * * * *